US007715736B2

(12) United States Patent
Nagata et al.

(10) Patent No.: US 7,715,736 B2
(45) Date of Patent: May 11, 2010

(54) IMAGE FORMING APPARATUS THAT DISPLAYS PROCESS INFORMATION REQUIRING EXECUTION RELATING TO EXCHANGED COMPONENTS,CONTROLLING METHOD OF THE SAME

(75) Inventors: Naohisa Nagata, Moriya (JP); Ichiro Sasaki, Toride (JP); Akinobu Nishikata, Kashiwa (JP); Satoru Yamamoto, Abiko (JP); Hiroshi Matsumoto, Toride (JP)

(73) Assignee: Canon Kabushiki Kaisha (JP)

( * ) Notice: Subject to any disclaimer, the term of this patent is extended or adjusted under 35 U.S.C. 154(b) by 788 days.

(21) Appl. No.: 11/470,222

(22) Filed: Sep. 5, 2006

(65) Prior Publication Data

US 2007/0053701 A1 Mar. 8, 2007

(30) Foreign Application Priority Data

Sep. 6, 2005 (JP) ..... 2005-258307

(51) Int. Cl.
*G03G 15/00* (2006.01)

(52) U.S. Cl. ..... 399/24; 399/81

(58) Field of Classification Search ..... 399/24–26, 399/31–35, 81; 361/679.21–679.3
See application file for complete search history.

(56) References Cited

U.S. PATENT DOCUMENTS 5,887,217 A * 3/1999 Mitekura et al. ..... 399/13

FOREIGN PATENT DOCUMENTS

| | | | |
|---|---|---|---|
| JP | 2000-056638 | A | 2/2000 |
| JP | 2003-215985 | A | 7/2003 |
| JP | 2004-144994 | A | 5/2004 |
| JP | 2004-147173 | A | 5/2004 |
| JP | 2005-205693 | A | 8/2005 |

* cited by examiner

*Primary Examiner*—David M Gray
*Assistant Examiner*—Ruth N Labombard
(74) *Attorney, Agent, or Firm*—Rossi, Kimms & McDowell LLP

(57) ABSTRACT

An image forming apparatus determines process items needed as exchanged components and an order of executing the process items needed for a plurality of kinds of exchanged components based on priority order information of the process items and causes a display unit to control a display for ordering to execute process items needed for the components according to the determined order of execution.

9 Claims, 23 Drawing Sheets

FIG. 10A 1001 1002 1003

| NAME OF PROCESS | PROCESSING ID | PRIORITY ORDER |
|---|---|---|
| TONER DENSITY ADJUSTMENT | 1 | 2 |
| COUNTER CLEARANCE | 2 | 1 |
| TEST PRINTING | 3 | 5 |
| CALIBRATION <GRADATION CORRECTION> | 4 | 3 |
| CALIBRATION <COLOR SHIFT CORRECTION> | 5 | 4 |
| FIXING ROLLER AGING | 6 | 2 |
| | | |
| | | |

FIG. 10B

| 1011 NAME OF COMPONENT | 1012 EXECUTION FLAG | 1013 PROCESS 1 | 1014 PROCESS 2 | 1015 PROCESS 3 | 1016 PROCESS 4 | PROCESS 5 |
|---|---|---|---|---|---|---|
| INTERMEDIATE TRANSFER BELT | 1 | 2 (1) | 5 (4) | 3 (5) | | |
| DRUM-Yellow | 1 | 2 (1) | 4 (3) | 5 (4) | 3 (5) | |
| DEVELOPING UNIT-Yellow | 1 | 2 (1) | 1 (2) | 4 (3) | | |
| FIXING ROLLER | 0 | 2 (1) | 6 (2) | | | |

FIG. 10C

| | PROCESS 1 | PROCESS 2 | PROCESS 3 | PROCESS 4 | PROCESS 5 | PROCESS 6 |
|---|---|---|---|---|---|---|
| EXECUTION PROCESSING | 2 (1) | 1 (2) | 4 (3) | 5 (4) | 3 (5) | |

FIG. 12

| NAME OF COMPONENT | PROCESS 1 | PROCESS 2 |
|---|---|---|
| A | COUNTER CLEARANCE | CALIBRATION 1 |
| B | COUNTER CLEARANCE | CALIBRATION 1 |
| C | COUNTER CLEARANCE | CALIBRATION 2 |

IMAGE FORMING APPARATUS THAT DISPLAYS PROCESS INFORMATION REQUIRING EXECUTION RELATING TO EXCHANGED COMPONENTS,CONTROLLING METHOD OF THE SAME

BACKGROUND OF THE INVENTION

1. Field of the Invention

The present invention relates to an image forming technique. Specifically, the present invention relates to an image forming apparatus that can display a process relating to an exchanged component on display unit according to a determined sequence of execution.

2. Description of the Related Art

Conventionally, an image forming apparatus such as a printer, a copying machine and the like requires regular exchanging or maintenance of components so as to keep predetermined image forming performance. For example, a service person calls at a place of a customer to perform exchange of components and calibration executed as maintenance of an image forming apparatus. At this moment, the service person checks a state of the apparatus or orders to start execution of various calibrations via an information display device such as a liquid crystal panel, a CRT or the like mounted on a manipulation unit of the image forming apparatus.

On the other hand, as the technical advancement of the image forming apparatus increases the number of components and the number of kinds of adjustment items, it has problems in that it complicates the maintenance operation and increases time spent for the maintenance.

As image forming apparatuses are improved in the image quality and speeded up, applications in the field called "Print On Demand: POD" of conventional image forming apparatuses mainly used in offices, which treats printed materials such as variable printing or on-demand publication involved in book binding used in the printing industry as commodity product, have been widened. In the field of POD, technical knowledge is necessary to manipulate an image forming apparatus in many ways, and if a trouble occurs, restore the apparatus in a short time to prevent the throughput from being lowered.

For example, the operator needs to execute the same operations as maintenance conventionally performed by a service person in a short time such as checking or exchanging operation of consumable components or components to be exchanged, image adjustment or the like after exchanging operation. Accordingly, operations by an operator are highly prone to operation errors than those performed by an experienced service person. If a time spent in the operations is long, it may affect shipment of printed materials as products.

As a technique for solving the problems, the Japanese Patent Laid-Open No. 2003-215985 discloses a technique for improving operability of the device by aiding operations of the operator with display/audio guidance on a maintenance processing procedure described in a manual or the like.

The Japanese Patent Application Laid-Open No. 2000-56638 discloses a technique for eliminating worker's trouble by automatically executing an adjustment operation in exchanging components; otherwise the operation is performed by a service person in exchanging components.

If common processing is executed for a plurality of times in exchanging a plurality of kinds of components to which the Japanese Patent Application Laid-Open No. 2003-215985 is applied and exchanging of each component is executed in order according to processing steps, however, common processing becomes redundant. That is to say, when an operation of exchanging each component is focused on, a correct operation according to processing is possible. If a processing step relating to exchanging of a plurality of kinds of components is focused on, the operation becomes inefficient as it executes the redundant processing steps.

A case where a service person or an operator performs adjustment processes (process 1, process 2) after exchanging a plurality of kinds of components, for example, three components of a component A, a component B, and a component C as shown in FIG. 12, according to the description of a manual, will be described.

First, an operator or the like performs a clearing process of a counter A (process 1) indicating the frequency of use of the component A and a calibration process 1 (process 2) for image adjustment, after exchanging the component A. Next, in exchanging the component B, the operator performs clearing process of a counter B (process 1) indicating a frequency of use of the component B and a calibration 1 (process 2) for image adjustment in exchanging the component B. Then finally, the operator or the like performs clearing process of a counter C (process 1) indicating a frequency of use of the component C and a calibration process 2 (process 2) for image adjustment after exchanging the component C.

In the case of the Japanese Patent Application Laid-Open No. 2003-215985, display/audio guidance can save an operator a trouble of reading a manual.

When the component A, the component B and the component C are exchanged at the same time, the "calibration 1" required in exchanging the component A is the same as the "calibration 1" required in exchanging the component B. Therefore, if an exchanging operation of components is serially executed in order according to processing steps, execution of the calibration 1 will be redundant.

When a plurality of kinds of components are exchanged at the same time and an adjustment operation required for each component is independently executed at the same time according to the Japanese Patent Application Laid-Open No. 2000-56638, processing which cannot be executed may be occur depending on a timing of an adjustment operation. In some cases, it may be more preferable to operate in serial according to processing steps than to operate in parallel.

SUMMARY OF THE INVENTION

The present invention is adapted in view of the above mentioned problems, and intends to provide an image forming apparatus which can determine necessary processes and a sequence of the processes and display them on display unit as a sequential operation flow when an operator exchanges a plurality of components.

According to the present invention, the foregoing object is attained by providing an image forming apparatus which can display processes relating to exchanged components on a display unit according to a determined order of execution comprising:

a determination unit adapted to determine process items needed as components are exchanged and an order of executing the process items needed for a plurality of kinds of exchanged components based on priority order information of the process items; and a display control unit adapted to cause the display unit to control a display for ordering to execute process items needed for the components according to the order of execution determined by the determination unit.

According to another aspect of the present invention, the foregoing object is attained by providing a controlling method of an image forming apparatus which can display processes relating to exchanged components on a display unit according to a determined order of execution, comprising:

a searching step of searching the exchanged components;

a determination step of determining process items needed as the exchanged components and an order of executing the process items needed for a plurality of kinds of components searched in the searching step based on priority order information of the process items; and a display control step of causing the display unit to control a display for ordering to execute process items needed for the components according to the order of execution determined in the determination step.

According to the present invention, when a plurality of components are exchanged, necessary processes and a sequence of the processes can be determined and they can be displayed on the display unit as a sequential operation flow.

Accordingly, an operator or the like can reduce downtime of an apparatus by streamlining of operations and prevent occurrence of operation errors by an operator or the like by selecting and executing a provided sequential operation flow.

Further features of the present invention will become apparent from the following description of exemplary embodiments (with reference to the attached drawings).

BRIEF DESCRIPTION OF THE DRAWINGS

FIGS. 10A to 10C are diagrams showing data structures of data showing relationship among a processing name to be executed after each component is exchanged, a priority order, a sequence of processes to be executed for each component (executed order) stored in RAM in an image forming apparatus according to the embodiment of the present invention;

FIG. 12 is a diagram for illustrating a conventional example.

DESCRIPTION OF THE EMBODIMENTS

First Embodiment

Figure 1:
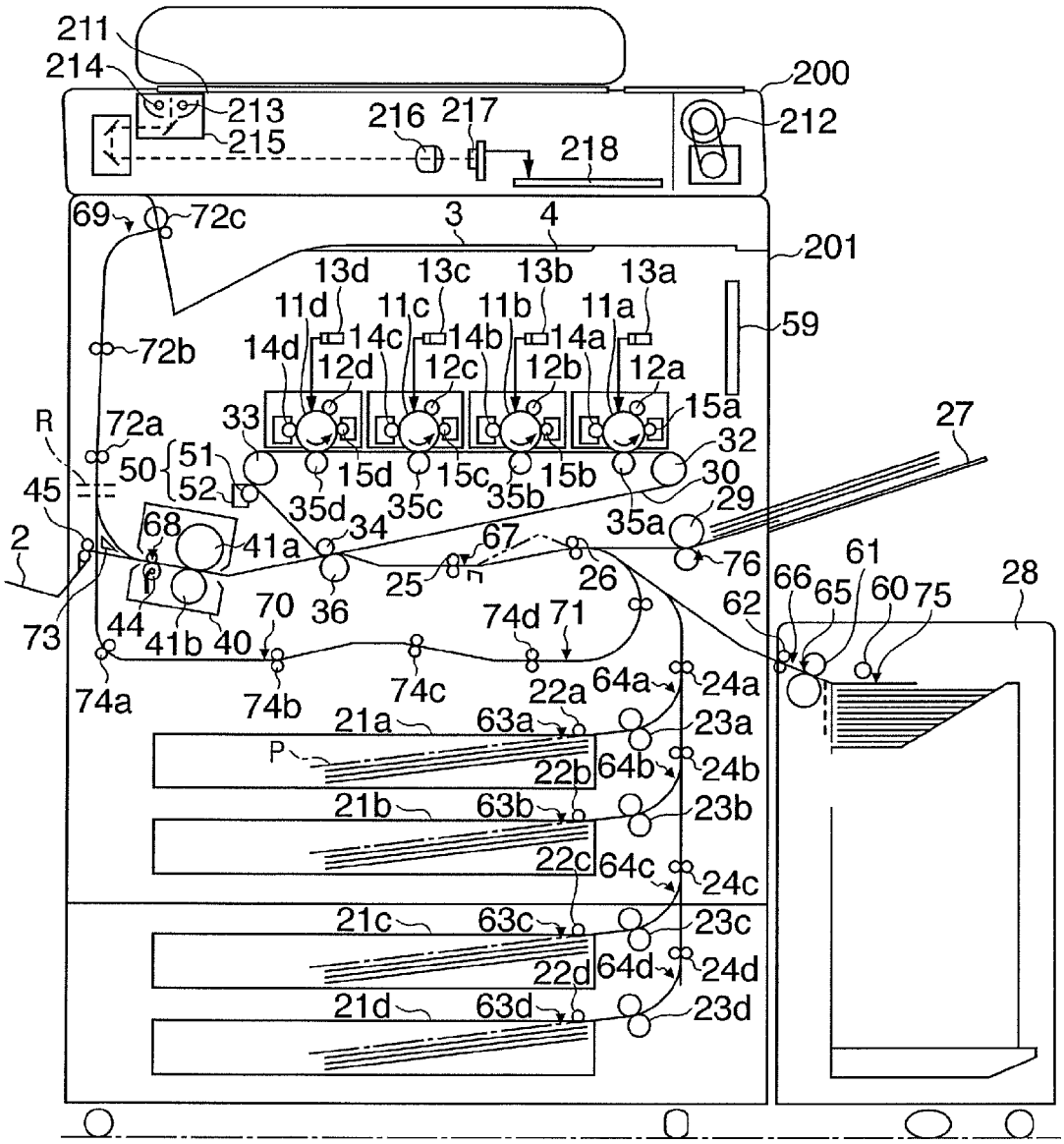
FIG. 1 is a diagram showing an outlined configuration of an image forming apparatus according to an embodiment of the present invention.

FIG. 1 is a diagram showing an outlined configuration of an image forming apparatus according to an embodiment of the present invention. Although a full color copying machine exemplifies the image forming apparatus in the figure, it is a matter of course that the spirit of the present invention is not limited to the example and can be applied to an image forming apparatus which executes monochrome copying.

In the figure, the reference numeral 200 designates a digital color image reader unit (hereinafter described as "reader unit"), under which a digital color image printer unit (hereinafter described as "printer unit") 201 is provided. Their configurations will be described below.

(Reader Unit 200)

In the reader unit 200, an original is placed on an original plate 211 and an original scanning unit 215 including exposures lamp 213 and 214 is exposed and scanned at a predetermined speed by an optical system reading driving motor 212.

Then, a reflected light image from the original is collected on a full color sensor (CCD) 217 by a lens 216, and a color separation image signal is obtained. As the full color sensor (CCD) 217, three lined CCDs attached with filters of R (red), G (green) and B (blue) placed next to each other can be used. The color separation image signal is sent out to the printer unit 201 after it is subject to image processing at an image processing unit 218.

A manipulation unit (not shown) is provided by the original plate 211, with switches for setting various modes relating to a copying sequence and a display and a display device for displaying being placed.

(Printer Unit 201)

Next, the printer unit 201 will be described.

In the printer unit 201, a control unit 59 is a controller unit consisting of a controller board including a CPU, RAM, ROM or the like. Based on a controlling program stored in the ROM, operations of a paper feed unit, intermediate transfer unit, a feeding unit, a fixing unit and a manipulation unit are controlled over.

(Image Forming Unit)

Photosensitive drums 11*a*, 11*b*, 11*c* and 11*d* as an image supporting body can be supported by the axes in their centers and driven by a driving motor (not shown) in the directions of arrows. Opposite to the rim of each of the photosensitive drums 11*a* to 11*d*, a roller chargers 12*a* to 12*d*, scanners 13*a* to 13*d*, developing units 14*a* to 14*d*, photosensitive drum cleaning units 15*a* to 15*d* are arranged in the rolling directions. The roller chargers 12*a* to 12*d* give electric charge of the even amount of charge on a surface of each of the photosensitive drums 11*a* to 11*d*.

An electrostatic latent image is formed on the photosensitive drums 11*a* to 11*d* as the scanners 13*a* to 13*d* expose a light such as a laser beam, for example, which is modulated according to a recorded image signal on the photosensitive drums 11*a* to 11*d*. Further, the electrostatic latent image is appeared by the developing units 14*a* to 14*d* each of which contains each of four developers (toners) of Black, Cyan, Magenta, and Yellow. The appeared visual image is transferred on an intermediate transfer belt 30. Remaining toner on the photosensitive drums 11*a* to 11*d* is then collected by the photosensitive drum cleaning units 15*a* to 15*d*. In the process shown above, image forming is performed sequentially by each toner.

(Paper Feed Unit)

The paper feed unit consists of a component for containing recording material P, a roller for conveying the recording material P, a sensor for detecting passage of the recording material P, a sensor for detecting the presence of the recording material P, and a guide (not shown) for conveying the recording material P along a feed channel.

Each of the reference numerals 22*a*, 22*b*, 22*c* and 22*d* designates a pickup roller for sending the recording material P from each of cassettes 21*a* to 21*d*, each of which contains the recording material P, a sheet by a sheet from the top. The reference numeral 27 designates a manual paper feed tray.

A plurality of sheets of recording material P may be sent out by the pickup rollers 22*a* to 22*d*, but BC rollers 23*a*, 23*b*, 23*c* and 23*d* surely separate them one by one. The recording material P separated one by one by the BC rollers 23*a* to 23*d* is conveyed by the drawing rollers 24*a* to 24*d* and a pre-resist-roller 26 and conveyed to the resist roller 25.

The recording material P contained in the manual paper feed tray 27 is separated one by one by the BC roller 29 and conveyed to the resist roller 25 by the pre-resist-roller 26.

The recording material P can also be fed from a paper feed unit 28 containing the recording material P into a printer unit 201 of the image forming apparatus 201.

A plurality of sheets of the recording material P contained in the paper feed unit 28 are conveyed to the paper feed roller 61 by the pickup roller 60, surely separated a sheet by a sheet by the paper feed roller 61 and conveyed to a drawing roller 62. The recording material P is further conveyed to the resist roller 25 by the pre-resist-roller 26.

(Intermediate Transfer Member)

Next, an intermediate transfer member will be described in detail. The reference numeral 30 designates an intermediate transfer belt, which is formed by a base layer consisting of PI, PVdF and the like, an electric elastic layer consisting of a urethane rubber, a silicon rubber, a CR rubber and the like on the base layer, and a surface layer consisting of fluorocarbon resin, an FKM or the like on the surface as materials. The reference numeral 32 designates a driving roller for transmitting a driving force to the intermediate transfer belt 30, supported by a tension roller 33 which gives an appropriate tension to the intermediate transfer belt 30 by pressure of a spring (not shown), and a driven roller 34 which forms a secondary transferring region with the intermediate transfer belt.

The driving roller 32 is driven by a stepping motor (not shown) to roll. On the reverse side of the intermediate transfer belt 30 which is opposite to each of the photosensitive drums 11*a*, 11*b*, 11*c* and 11*d* with the intermediate transfer belt 30, primary transferring rollers 35*a* to 35*d* for applying a high voltage for transferring a toner image on the intermediate transfer belt 30 are placed. A secondary transferring roller 36 is placed opposite to the driven roller 34 and a secondary transferring region is formed by a nip between the secondary transferring roller 36 and the intermediate transfer belt 30. The secondary transferring roller 36 is pressed with an appropriate pressure to the intermediate transfer belt.

At the downstream of the secondary transferring region, a cleaning device 50 for cleaning an image forming surface of the intermediate transfer belt 30 is placed. The cleaning device 50 consists of an electric fur blush 51, a bias roller (not shown) for applying a bias to the fur blush and a waste toner box 52 for containing waste toner.

(Fixing Unit)

Fixing unit 40 has a fixing roller 41*a* with a heat source such as a halogen heater inside, and a roller 41*b* pressed by the fixing roller 41*a* (the roller may also have a heat source). The fixing unit 40 has an inside paper discharging roller 44 for conveying the recording material P which is discharged from a pair of the abovementioned rollers (41*a*, 41*b*).

(Conveying of Recording Material P)

Conveying of the recording material P conveyed to the resist roller 25 pauses as driving to roll rollers upstream of the resist roller 25 is stopped. Then, driving to roll the upstream rollers including the resist rollers 25 is resumed at an image forming timing of the image forming unit and the recording material P is sent out to a secondary transferring region to be described later.

An image is transferred on the secondary transferring region, and the recording material P on which the image is fixed in the fixing unit 40 passes the inside paper discharge roller 44, and then a switching flapper 73 switches the destination of the conveyance. If the switching flapper 73 is at the face up discharging paper side, the recording material P is discharged on a face up discharge tray 2 by an outside paper discharge roller 45.

On the other hand, if the switching flapper 73 is at the face down paper discharging side, the recording material P is conveyed in the direction toward a flip rollers 72*a*, 72*b* and 72*c* and discharged to the facedown paper discharge tray 3.

On a feed channel of the recording material P, a plurality of sensors including paper feed retry sensors 64*a* to 64*b*, a paper feed sensor 65, and a drawing sensor 66 are placed for detecting passage of the recording material P. On the feed channel of the recording material P, a resist sensor 67, an inside paper discharge sensor 68, a face down paper discharge sensor 69, double-sided pre-resist sensor 70, a double-sided paper re-feed sensor 71 and the like are placed.

In cassettes 21*a* to 21*d* for containing the recording material P, sensors for presence of cassette paper 63*a* to 63*d* for detecting the presence of the recording material P are placed. In the manual paper feed tray 27, a presence of paper in a manual paper feed tray sensor 74 for detecting the presence of the recording material P on the manual paper feed tray 27 is placed, and in the paper feed unit 28, a paper sensor 75 for detecting the presence of the recording material P in the paper feed unit 28 is placed.

(Operations of Image Forming Apparatus)

Next, operations of image forming apparatus will be described by taking an example of a case where the recording material P is conveyed from the cassette 21*a*.

After a predetermined time passed from starting of a job, first the transferring material P is sent out a sheet by a sheet from the cassette 21*a* by the pickup roller 22*a*. Then, the transferring material P is conveyed via the drawing roller 24*a* and the pre-resist roller 26 to the resist roller 25 by the paper feed roller 23. At the moment, the resist roller 25 is stopped, with a leading edge of the recording material P touching a nip part.

Next, the resist roller 25 starts rolling in accordance with the timing as the image forming unit starts forming an image. The timing of a rolling time is set so that the transfer material P and a toner image which is primarily transferred on the intermediate transfer belt by the image forming unit just match in the secondary transferring region.

On the other hand, when an image forming operation start signal is issued, a toner image is formed on the most upstream photosensitive drum 11*d* in the rolling direction of the intermediate transfer belt 30 by the abovementioned process at the image forming unit. The toner image is primarily transferred to the intermediate transfer belt 30 at the primary transferring region by the transferring roller 35*d* on which a high voltage is applied. The primarily transferred toner image is conveyed to the next primary transferring region.

Image forming is performed with a delay by time for the toner image is conveyed between respective image forming units. The tip of an image is aligned to the previous image and the next toner image is transferred. The same processes are repeated thereafter, resulting in four colors of a toner image being primarily transferred on the intermediate transfer belt 30.

Thereafter, when the recording material P goes into the secondary transferring region and touches the intermediate transfer belt 30, a high voltage is applied to the secondary transferring roller 36 in accordance with timing as the recording material P passes. Then the four colors of a toner image are transferred on the surface of the recording material P formed on the intermediate transfer belt by the abovementioned processes. After that, the recording material P is guided to a fixed roller nip part. Then, a toner image is fixed on the surface of the recording material P by a heat and a pressure of a nip of the pair of rollers 41*a*, 41*b*. Next, the recording material P is discharged to a face up paper discharge tray 2 or a face down tray 3 according to the switching direction of the switch flapper.

(Configuration of Control Unit 59)

Figure 8:
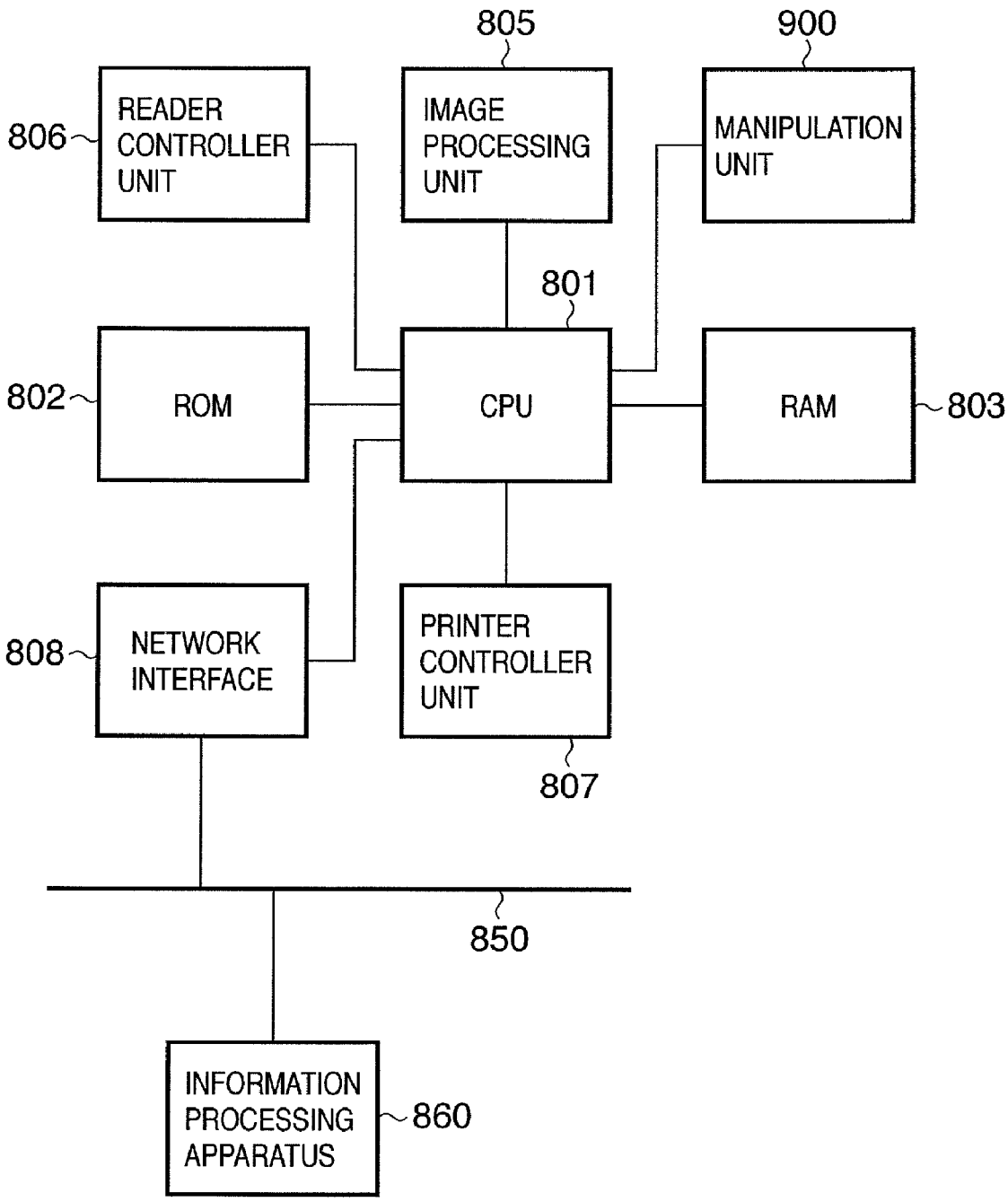
FIG. 8 is a control block diagram showing a configuration of a control unit 59 in the image forming apparatus according to the embodiment of the present invention.

FIG. 8 is a control block diagram showing a configuration of a control unit 59. A CPU 801 executes basic control of a full color copying machine. When an operator or the like exchanges a plurality of kinds of components, it is assumed that processing for optimizing and determining necessary processes and a sequence of the processes and displaying them on display unit as a sequential operation flow is executed under the entire control of the CPU 801.

ROM 802 on which a control program is written and RAM 803 which functions as a work area for performing processes are connected to the CPU 801 via an address bus and a data bus. To the ROM 802, it is assumed that a control program and the like for executing the steps shown in FIG. 2A, 2B to be described later are stored.

The reader controller unit 806 and the printer controller unit 807 are an electric circuit including input/output ports and the like for controlling respective components of a reader unit 200 and a printer unit 201. The CPU 801 controls the reader controller unit 806 and the printer controller unit 807 and executes an image forming operation according to the contents of the control program stored in the ROM 802. The image processing unit 805 executes each screen processing on digital data of the original image converted by the reader controller unit 806. To the CPU 801, the manipulation unit 900 is connected, and a result of executing the control program or the like can be displayed on display unit under the control of the CPU 801.

The image forming apparatus according to the embodiment can display processes relating to the exchanged components on the manipulation unit 900 according to the determined order of execution. The image forming apparatus has a determination unit for determining process items needed as components are exchanged and an order of executing the process items needed for a plurality of kinds of exchanged components based on priority order information of the process items. The image forming apparatus has a display control unit for causing the manipulation unit 900 to display a display for ordering to execute a process item needed for the components according to the order of execution determined by the determination unit. In such a case, processes of the determination unit and the display control unit can be executed under the control of the CPU 801.

The RAM 803 can store information on process items needed for each component and a priority order of each of the process items. The determination unit of the image forming apparatus can determine the order of execution by referencing information stored in the RAM 803.

The CPU 801 can communicate with an information processing apparatus 860 each other via a network interface 808 and a network 850. Information on process items and priorities can be stored in the data storing unit (not shown) of the information processing apparatus 860 for the CPU 801 to obtain necessary information from the information processing apparatus 860 when the order of execution is determined.

(Configuration of Manipulation Unit 900)

Figure 9A:
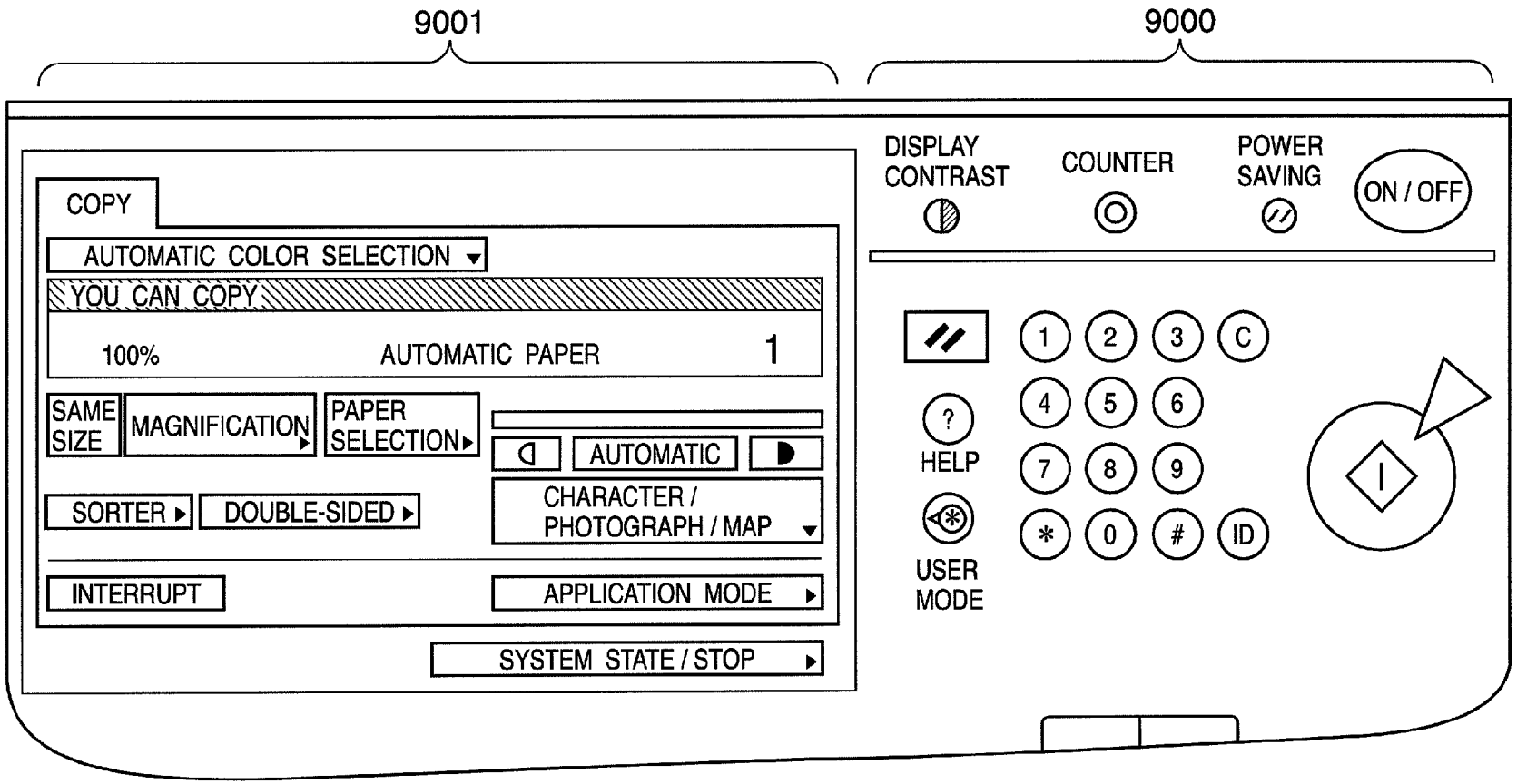
FIGS. 9A to 9C are diagrams showing manipulation units in the image forming apparatus according to the embodiment of the present invention.
Figure 9B:
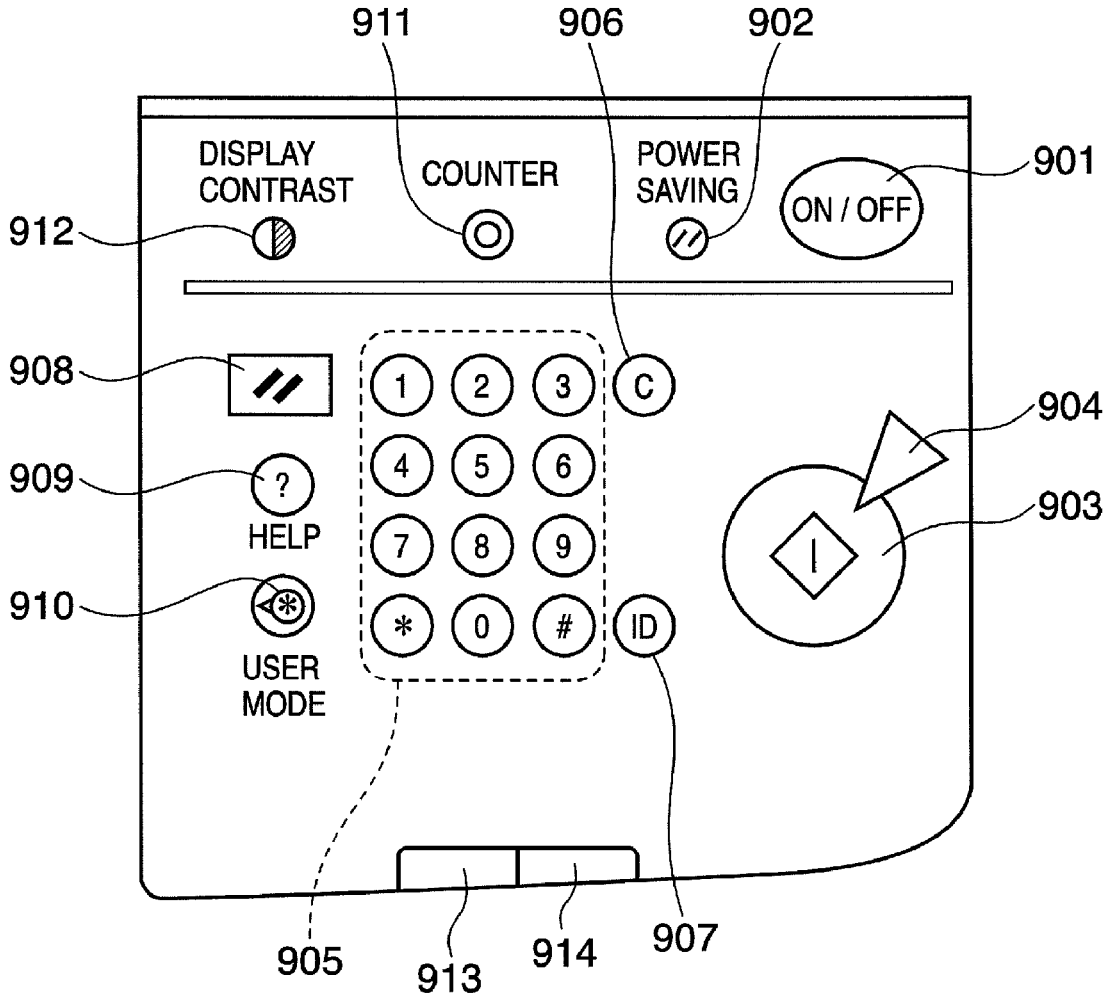
Figure 9C:
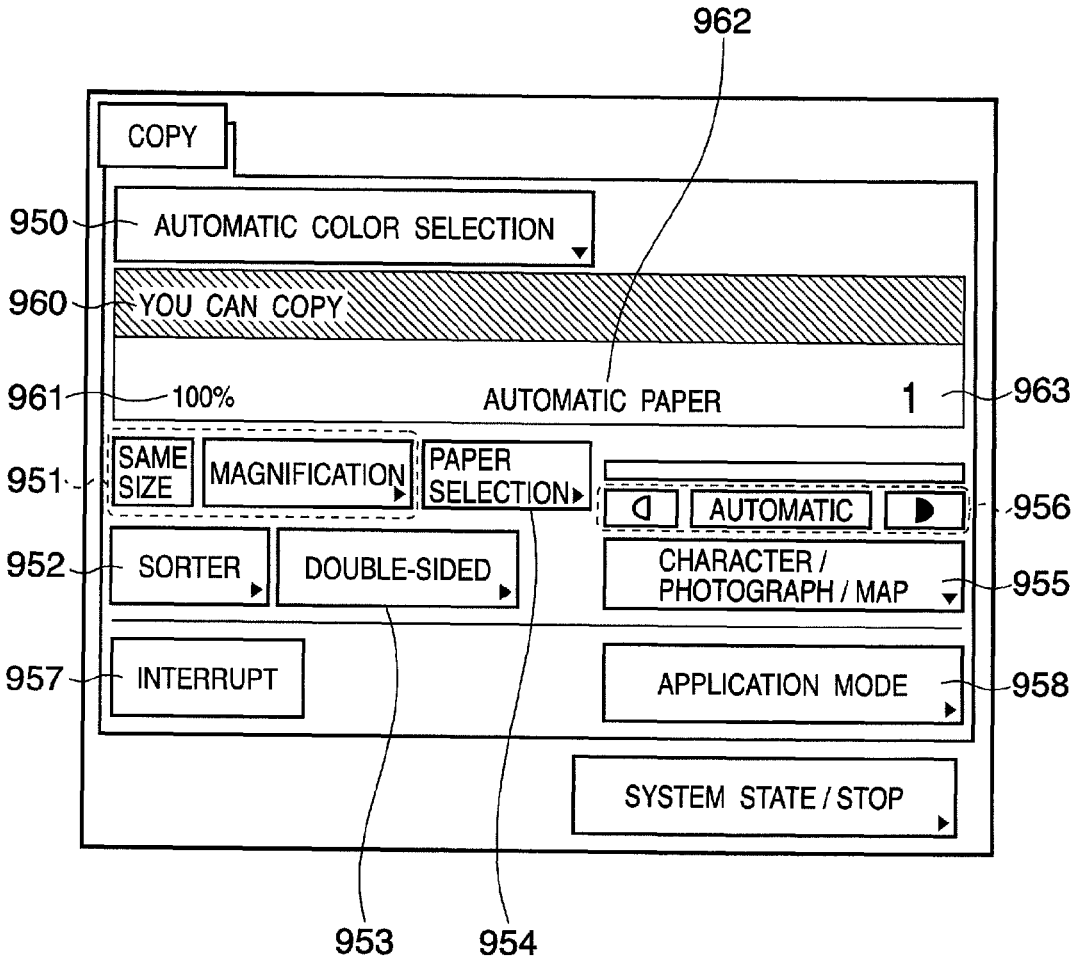

FIG. 9A is a diagram schematically showing the manipulation unit 900, consisting of a key input portion 9000 and a touch panel portion 9001. FIG. 9B and FIG. 9C show details of the respective components. The details will be described in detail below.

FIG. 9B is a key inputting component for enabling a regular manipulation setting. The manipulation unit power switch 901 is for switching between a standby mode (normal operation state) and a sleep mode (state of reducing electric power consumption). It can be controlled while a main power switch for supplying power to the entire image forming apparatus is ON.

A power saving key 902 is a key for enabling to set to reduce power consumption by lowering a control temperature of the fixing device in the standby mode, though it needs a time to enter into a print available state. The control temperature can also be lowered by setting a power saving rate.

A start key 903 is a key for ordering to start copying or the like. A stop key 904 is a key for stopping a copying operation. A ten key 905 is numeric keys for putting numbers for various settings. A clear key 906 is a key for releasing the put numbers. An ID key 907 is a key for inputting a predetermined personal identification number to authorize an operator of the apparatus.

A reset key 908 is a key for voiding various settings and returning them to default states. A help key 909 is a key for displaying guidance or a help. A user mode key 910 is a key for transferring to a user mode screen on which a system setting or various kinds of adjustment and the like are performed.

Here, the contents of the user mode screen to be displayed by the user mode key 910 differ for personal identification numbers set by the ID key 907. That is to say, it can restrict an executable system setting and the adjustment contents by identifying the operator of the apparatus among a user, an operator and a service person by a personal identification number and changing display items on a user mode screen.

A counter check key 911 is a key for causing a soft counter for counting the number of prints or the like to display the outputted number of sheets stored therein. Respective outputted number of sheets can be displayed according to an operation mode such as copy/print/scan, a color mode such as color/monochrome, or the size of a sheet of paper such as large/small.

The image contrast dial 912 is a dial for adjusting viewability of a screen by dimming a backlight of a liquid crystal display on a touch panel unit. An execution/memory lamp 913 is a lamp for notifying that a job is being executed or a memory is being accessed by flashing. An error lamp 914 is a lamp for notifying that a job cannot be executed or an error of a service person's call, or at an occasion of an operator's call for notifying a jam or out of consumable items by flashing.

Next, FIG. 9C is a schematic diagram representing an LCD (Liquid Crystal Display) and a touch panel display consisting of transparent electrodes affixed thereon. When a finger touches the transparent electrodes at a component corresponding to a key displayed on the LDC, it is previously programmed such as detecting it and displaying another operation screen. The figure is an initial screen in a standby mode and various manipulation screens can be displayed according to the setting operation.

A color selection setting key 950 is a key for previously selecting among color copying, monochrome copying or automatic selection. A magnification setting key 951 is a key for transferring a display to a screen for setting magnification such as the same size, enlargement, reduction and the like. A post processing setting key 952 is a key for transferring a display to a screen for setting the presence, the number, the place and the like of a staple or a punch. A double-side setting key 953 is a key for transferring a display to a screen for selecting whether it is single sided printing or double sided printing.

A paper size setting key 954 is a key for transferring a display to a screen for selecting a paper feeding stage, the size of a sheet of paper, and a medium type. An image mode setting key 955 is a key for selecting an image mode appropriate to an original image such as a character mode or a photograph mode. A density setting key 956 is a key for adjusting an outputted image to make it darker or brighter.

Next, a status display portion 960 is a display unit for performing a simple state displaying such as a standby state, being warmed up, a jam, an error or the like. A magnification display portion 961 displays a magnification set by the magnification setting key. A paper size display portion 962 displays the size of the paper or a mode set by the paper size setting key 954. A number of sheets display portion 963 can display the number specified by the ten key 905 or the currently being printed page in operation.

An interruption key 957 is used to make another job interrupt during a copying operation. An application mode key 958 is a key for transferring a display to a screen for performing settings such as various image processes, layouts or the like including continuous shooting of pages, settings of a cover/inserting paper, a scaling down layout, image movement or the like.

(Inside Configuration of the Image Processing Unit 805)

Figure 3:
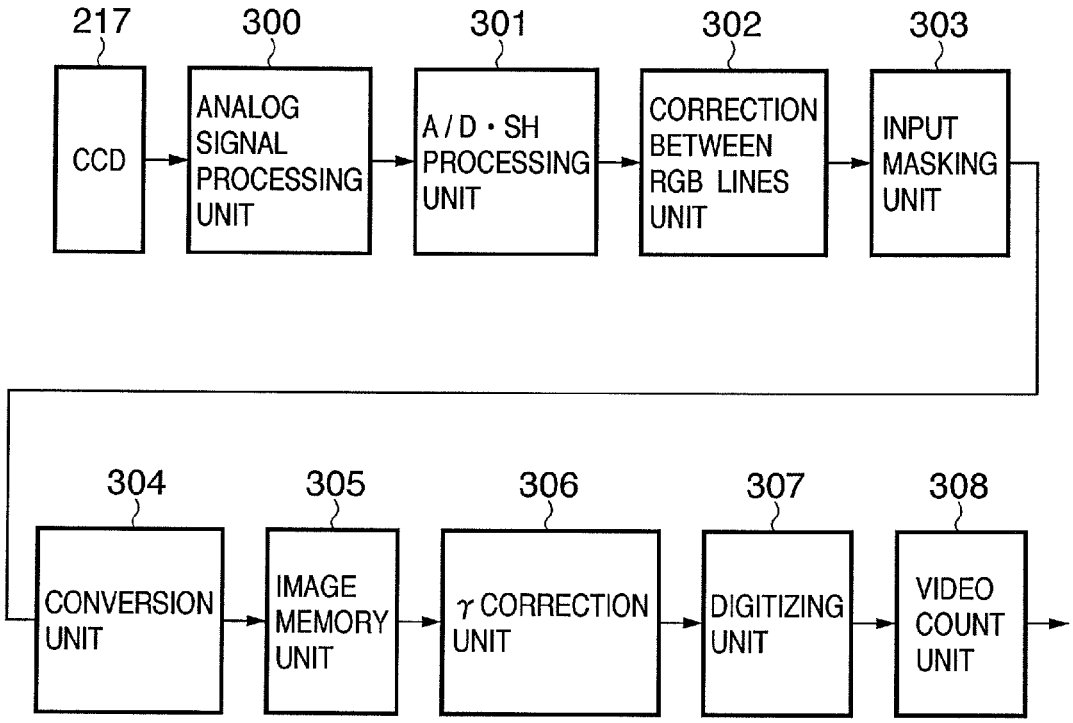
FIG. 3 is a block diagram showing an inside configuration of an image processing unit 805 in the image forming apparatus according to the embodiment of the present invention.

Next, a configuration of the image processing unit will be described with reference to a block diagram of FIG. 3. FIG. 3 is a block diagram showing an inside configuration of the image processing unit 805 in FIG. 8.

An original image formed on the CCD sensor 217 is converted into an analog electric signal by the CCD sensor 217. Image information converted into the analog electric signal is inputted into an analog signal processing unit 300 and is subject to correction or the like of sample & hold, dark level, and is subject to analog/digital conversion (A/D conversion) at an A/D•SH processing unit 301 at first. A shading (SH) correction is further performed on the digitalized signal. In the shading correction, correction is performed on a variation for each pixel of the CCD sensor 217, and a variation of the amount of light by a place based on a deflecting characteristic of an original lighting lamp.

Then, correction between RGB lines is performed in a correction between RGB lines unit 302. As a light inputted into each of RGB photoreceptors of the CCD sensor 217 at some moment is shifted depending on physical relationship of respective RGB photoreceptors on the original, it is synchronized between RGB signals at the correction between RGB lines unit 302.

Thereafter, the light is subject to input masking processing at an input masking unit 303 and converted from brightness data into density data. As the RGB values outputted from the CCD sensor 217 are influenced by a color filter attached to the CCD sensor 217, the influence is corrected and converted into a pure RGB value.

Next, the image is subject to scaling processing with a desired scaling rate at a conversion unit 304 and the scaled image data is sent to an image memory unit 305 and accumulated.

For the accumulated image, image data is first sent from the image memory unit 305 to a γ correction unit 306. At the γ correction unit 306, original density data is converted into density data which corresponding to a desired outputted density based on a look up table (LUT) which takes into account of characteristics of a printer to make it an output according to the density value set at the manipulation unit 900. Next, the density data is sent to a digitizing unit 307. At the digitizing unit 307, a multilevel signal of eight bits is converted into a binary signal. For example, the converting method includes a Dither method, a difference diffusing method, and an improved difference diffusing. The digitized data is sent to the video count unit 308 and counted for each color image.

(Regarding a Manipulation Screen to be Used When a Plurality of Kinds of Components are Exchanged)

Next, a manipulation screen used when a worker such as a service person, an operator or the like exchanges a plurality of kinds of components at maintenance of an image forming apparatus according to the embodiment will be described in detail.

Figure 4A:
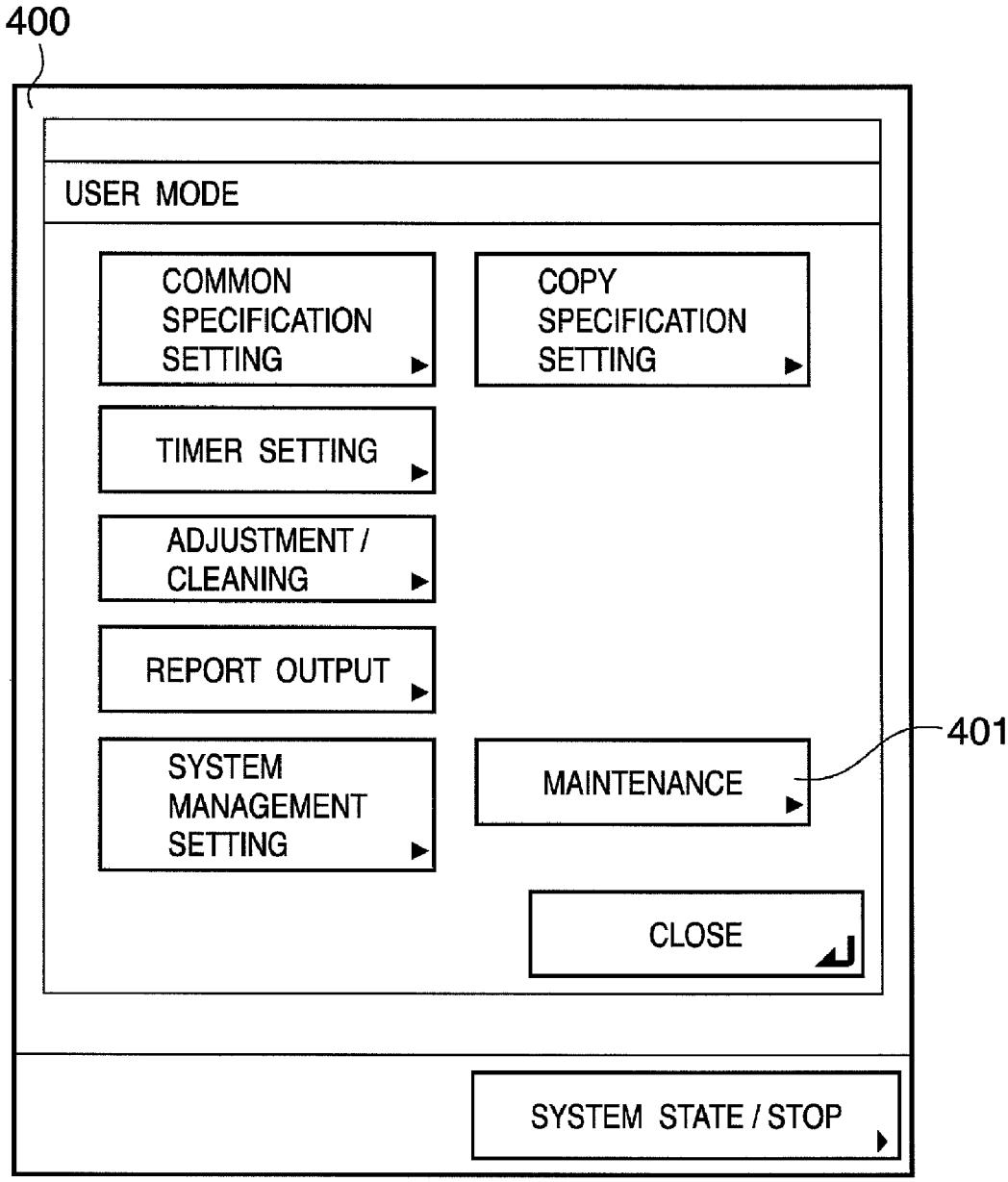
FIGS. 4A and 4B are diagrams showing a user mode screen and a maintenance screen in an image forming apparatus according to the embodiment of the present invention.
Figure 4B:
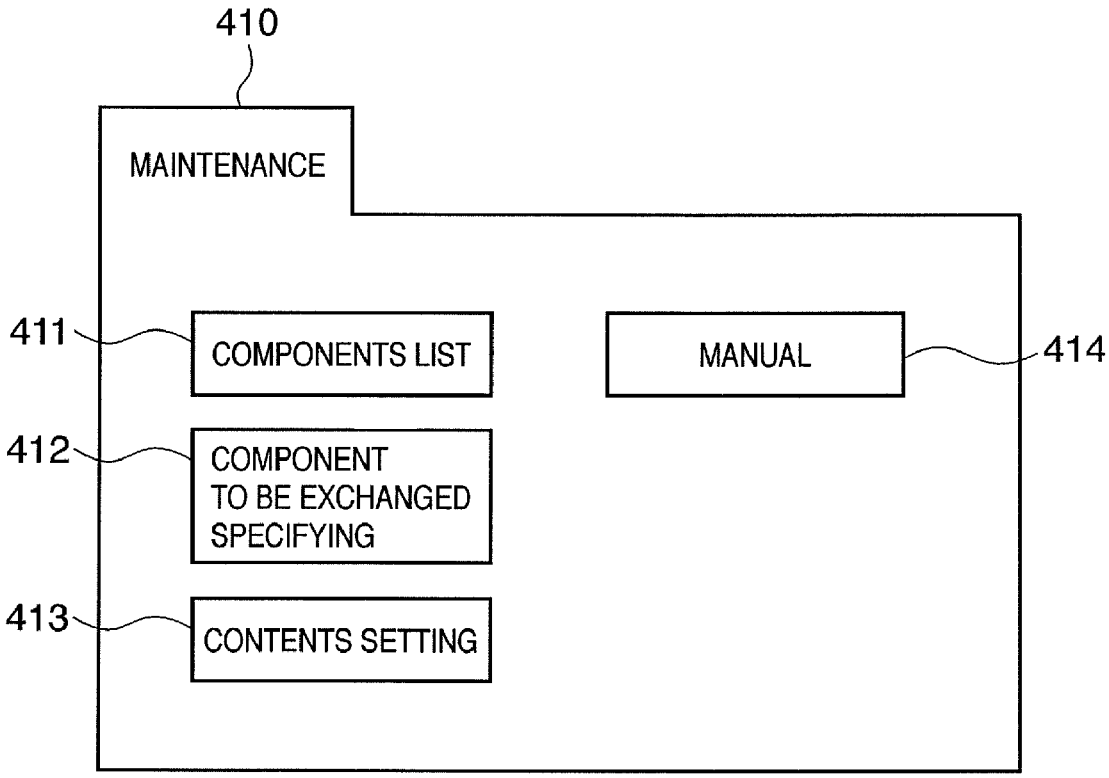

On the manipulation screen (user mode screen), a user mode screen 400 shown in FIG. 4A is displayed in response to pressing of the user mode key 910 in FIG. 9B. On the user mode screen, various settings and adjustment items keys are displayed and a maintenance screen 410 shown in FIG. 4B is displayed in response to pressing of a maintenance key 401. On the maintenance screen 410, a components list key 411 for displaying components to be exchanged and their usage states, and a component to be exchanged specifying key 412 for specifying a component which is exchanged at maintenance are present. On the maintenance screen 410, a contents setting key 413 for setting adjustment processing contents which need to be executed after a component is exchanged and its priority order, and a manual key 414 for illustrating a procedure of a components exchanging operation are present.

(Components List Screen)

Figure 5:
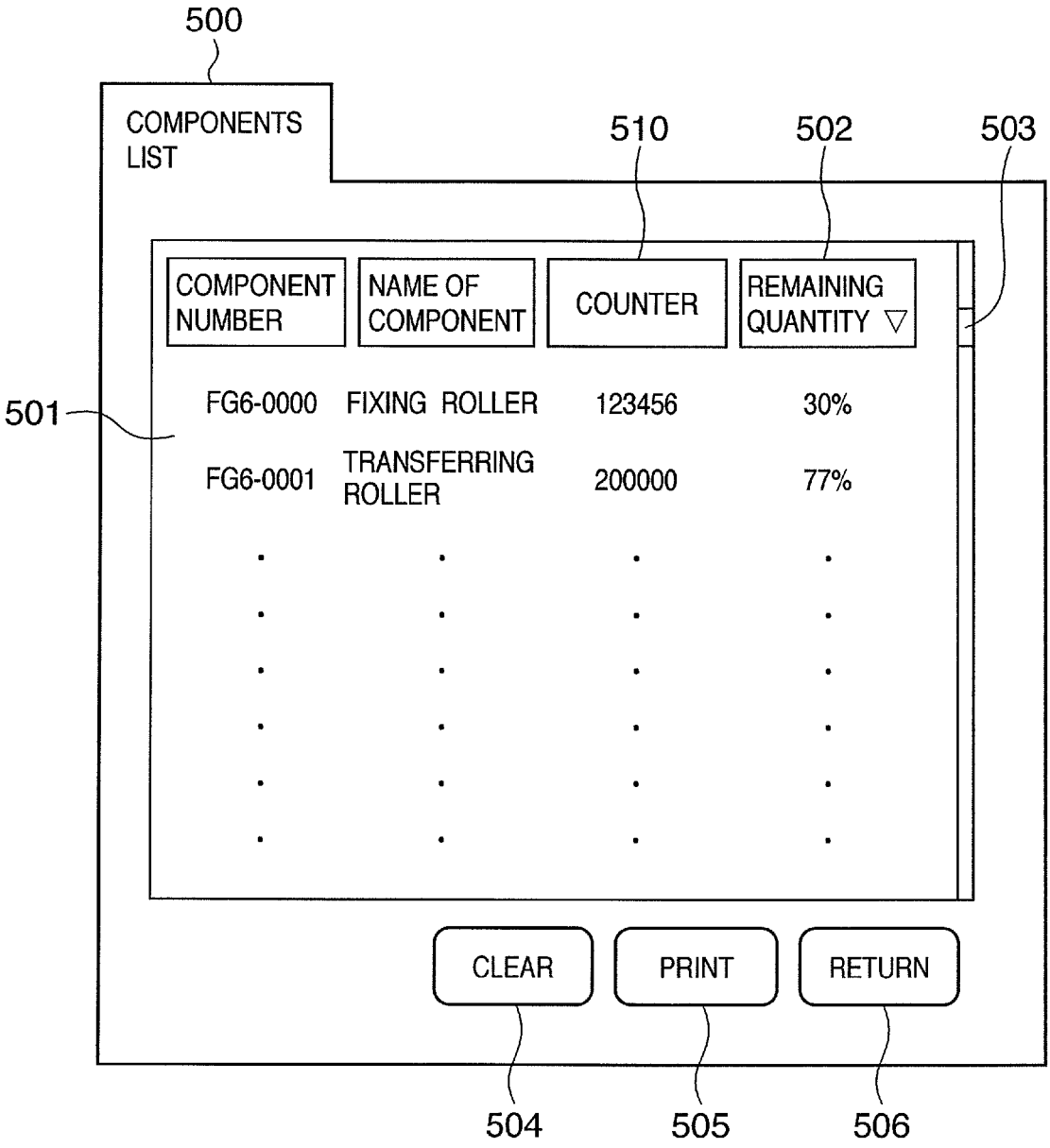
FIG. 5 is a diagram showing a components list screen in the image forming apparatus according to the embodiment of the present invention.

When a worker presses the components list key 411 of FIG. 4B, a components list screen 500 as shown in FIG. 5 is displayed. In FIG. 5, the reference numeral 501 designates a display column for displaying information relating to a component to be exchanged, which displays information on a component number (component number), a component name, a counter and a remaining quantity for each component. The reference numeral 502 designates a sort key for sorting the order of components to be displayed in a descending order or an ascending order of values of the remaining quantity (ratio). The reference numeral 503 designates a scroll bar, which can display components information outside the screen as being scrolled.

The reference numeral 504 designates a clear key, which enables to clear a counter value 510 to zero as a counter value 510 at a time of exchanging a component is selected and a clear key 504 is selected. As the counter value is cleared to zero, a value (ratio) indicated by the remaining quantity 502 becomes 100%. The reference numeral 505 designates a print key, which can print out information on a components list on a recording material. The reference numeral 506 is a return key, which enables to switch a display of the maintenance screen 410 in response to pressing of the button.

(Components to be Exchanged Specifying Screen)

Figure 6A:
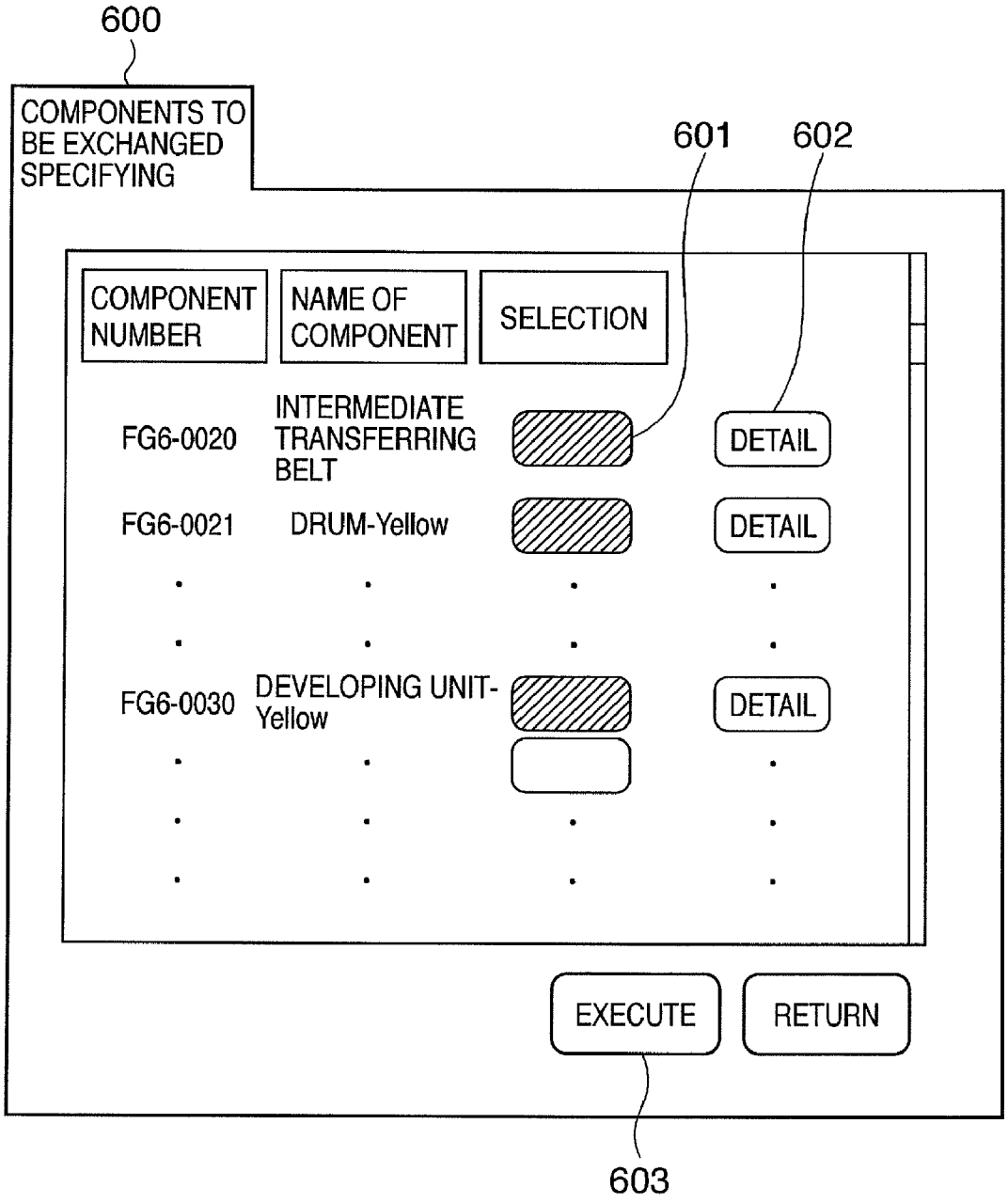
FIGS. 6A and 6B are diagrams showing components to be exchanged specifying screen in the image forming apparatus according to the embodiment of the present invention.
Figure 6B:
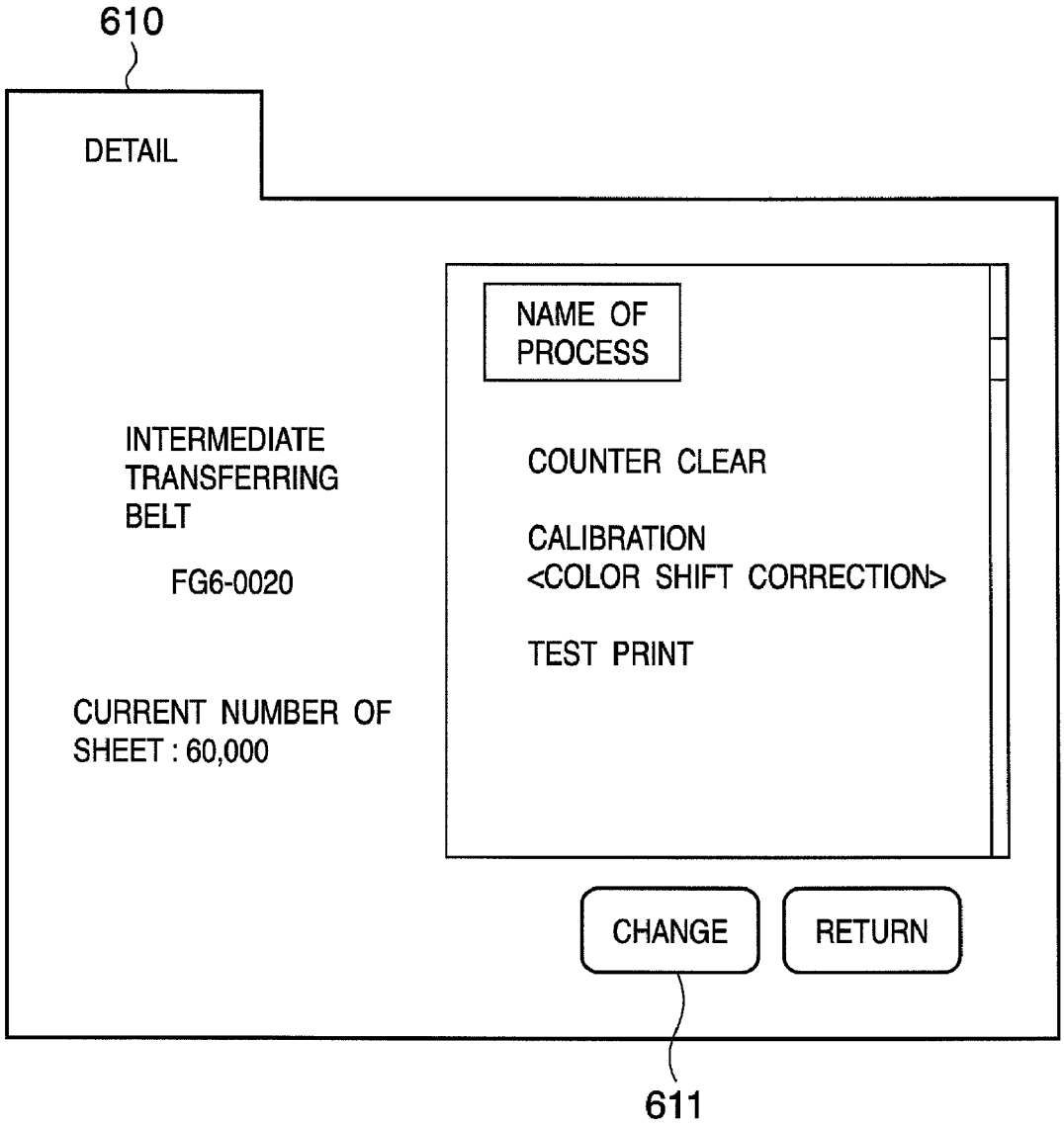

When a worker presses the components to be exchanged specifying key 412 of FIG. 4B, a components to be exchanged specifying screen 600 as shown in FIG. 6A is displayed. In FIG. 6A, the reference numeral 601 designates a selection key, by which a worker can select an exchanged component. The reference numeral 602 designates a detail key for displaying and setting the contents of processing to be executed after exchange. A detail screen 610 as shown in FIG. 6B is displayed as the worker selects the key.

On the detail screen 610, processing needed after a component is exchanged can be displayed in processing order and processing contents can be added or deleted by a change key 611.

Returning the description to FIG. 6A, an execution key 603 is a key for starting adjusting processing after exchange for a component selected by the selection key 601 after a component is exchanged.

(Contents Setting Screen)

Figure 7:
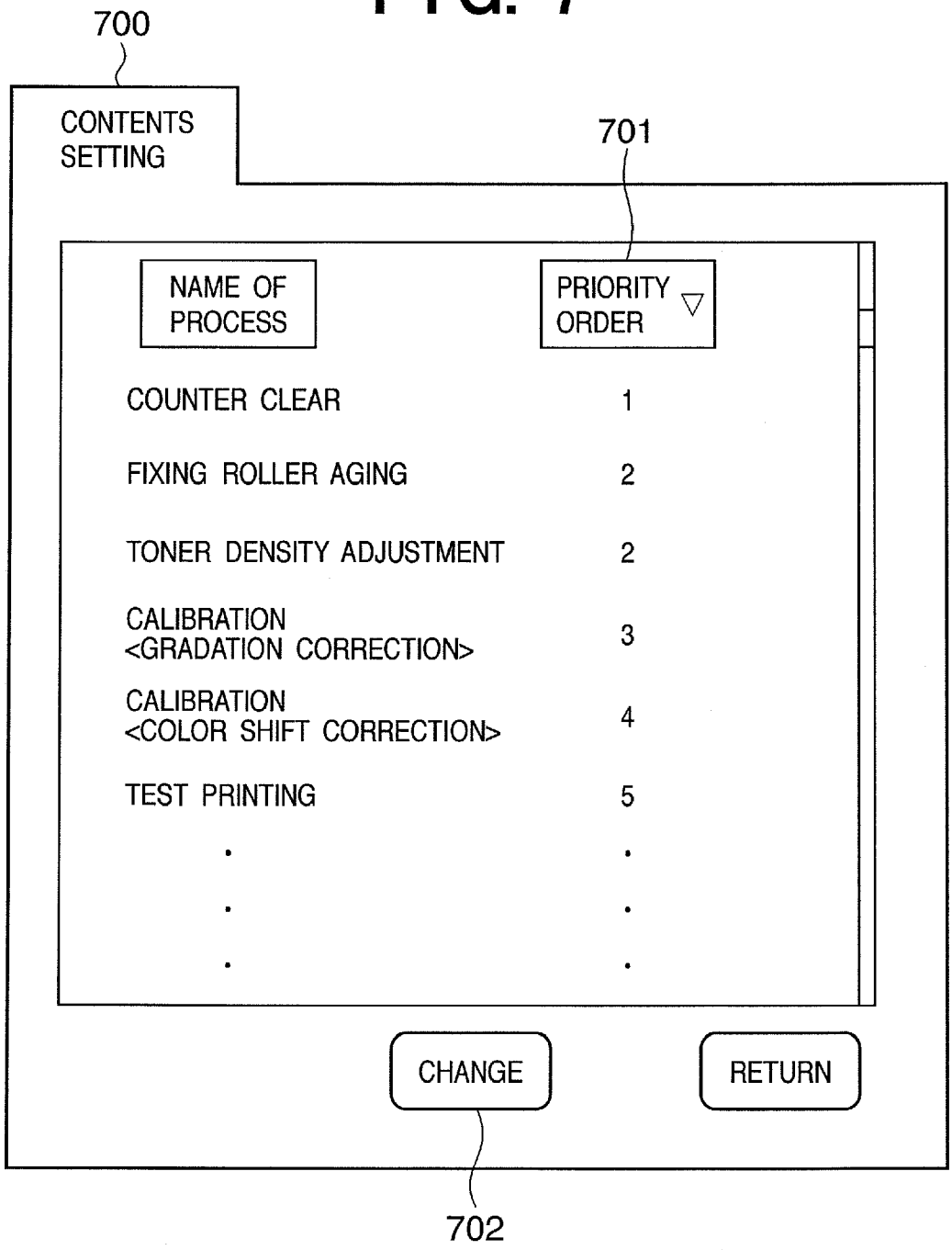
FIG. 7 is a diagram showing a contents setting screen in the image forming apparatus according to the embodiment of the present invention.

When a worker presses the contents setting key 413 of FIG. 4B, the contents setting screen 700 as shown in FIG. 7 is displayed. On the contents setting screen 700, names of processes needed after exchanging of components and their priorities are displayed. The priorities are such that the smaller value comes first and those with the same priority order can be executed at the same time. The reference numeral 701 designates a sort key, which can exchange the order of processes to be displayed by sorting them in the descending order or the ascending order of their priorities. The reference numeral 702 is a change key, which is a key for performing add, delete of names of processes and change of priorities. The results of add, delete, and the resulted priorities by the change key 702 are reflected on a display of the contents setting screen 700 in response to pressing of the sort key 701.

(Procedure of Exchanging Components at Maintenance)

Next, in the image forming apparatus according to the embodiment of the present invention, a procedure of exchanging a component in maintenance which forms a characterizing feature will be described in detail with reference to flowcharts of FIG. 2A, B. It will be described as a procedure of exchanging three components of an intermediate transfer belt 30, a photosensitive drum 11*d* corresponding to a yellow toner, and a developing unit 14*d* corresponding to a yellow toner in the image forming apparatus shown in FIG. 1 as an example of exchanging of a component with reference to flowcharts of FIGS. 2A and 2B. In the display in the components to be exchanged specifying screen 600 below, the photosensitive drum 11*b* is indicated as "drum-Yellow", and the developing unit 14*d* is indicated as "developing unit-Yellow".

A worker such as a service person or an operator first performs an exchanging operation of a component. When an objective component has been exchanged, the worker causes a user mode screen 400 (FIG. 4A) to be displayed by pressing a user mode key 910 (FIG. 9B) and presses the maintenance key 401. With that manipulation, the maintenance screen 410 is displayed.

Next, the worker causes the components to be exchanged specifying screen (600 of FIG. 6A) to be displayed by selecting the component to be exchanged specifying key 412 of the maintenance screen 410. Then, as shown in the components to be exchanged specifying screen 600 of FIG. 6A, selection keys 601 of an intermediate transfer belt, a drum-Yellow, a developing unit-Yellow, which are components exchanged among names of components shown in the components to be exchanged specifying screen 600 of FIG. 6A, and presses the execution key 603.

Figure 2A:
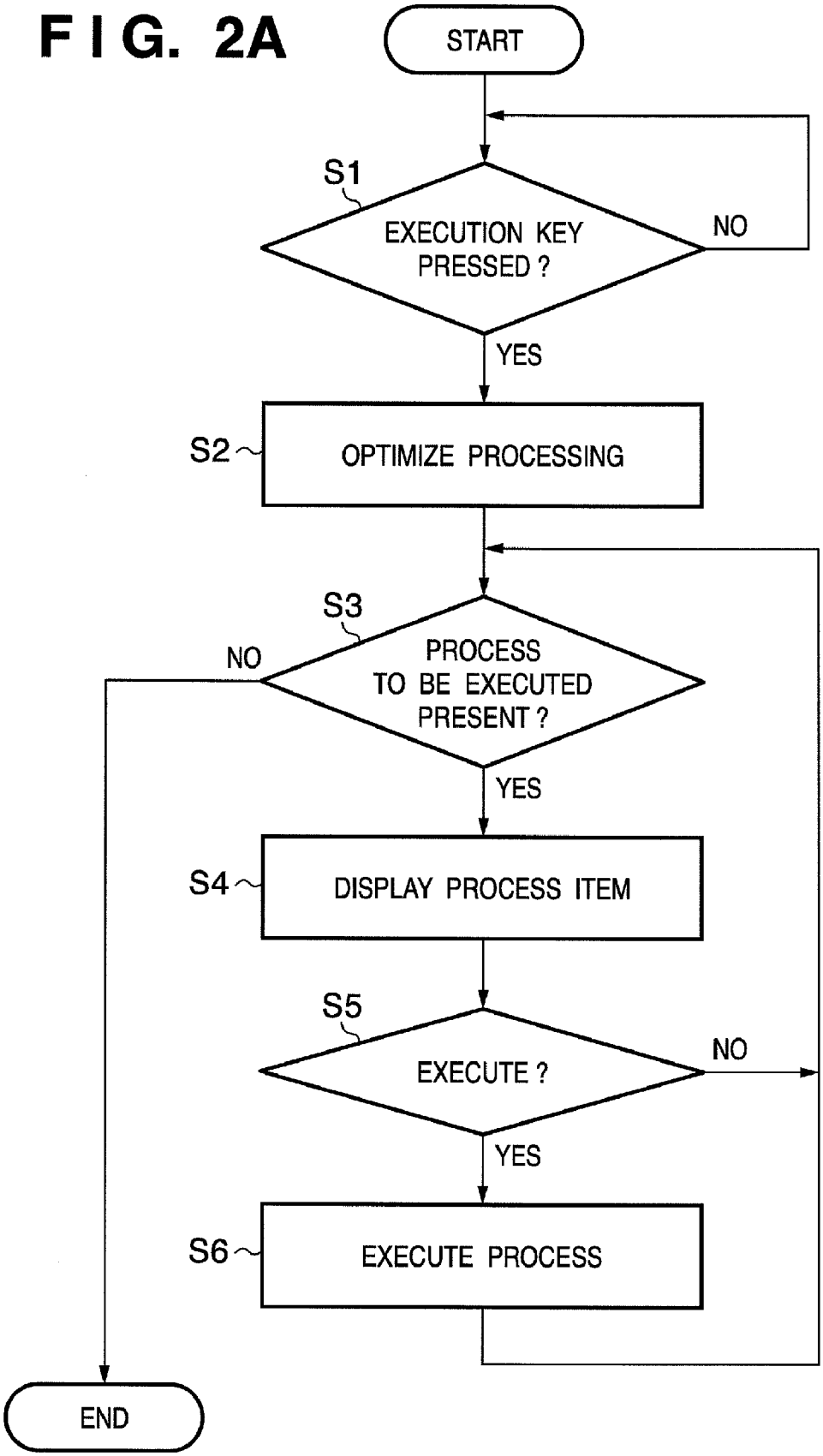
FIG. 2A is a flowchart showing a processing procedure after a component is exchanged in the embodiment of the present invention.

The image forming apparatus determines whether the execution key 603 is pressed at the step S1 of FIG. 2A or not. If the execution key 603 is not pressed (S1-NO), it enters into a waiting state as waiting for key inputs. When the execution key 603 is pressed (S1-YES), the processing proceeds to the step S2, and performs optimization of the processing (decision of an appropriate processing procedure (execution order)).

At the step S2, the CPU 801 determines an optimum processing procedure from data stored on the RAM 803 based on information on a selected component and start of execution.

FIGS. 10A to 10C are diagrams showing data structures of data showing relationship among a processing name to be executed after each component is exchanged, a priority order, a sequence of processes to be executed for each component (execution order) stored in the RAM 803.

FIG. 10A shows relationship between process items (name of process) and priorities. The reference numeral 1001 designates a name of process, the reference numeral 1002 designates a processing ID for identifying the name of a process, and the reference numeral 1003 designates priority order assigned to each of the name of process, each of whose value is the smallest can be executed first and those with the same value can be executed at the same time.

FIG. 10B shows relationship between a component to be exchanged and processing to be executed after the exchange, with the reference numeral 1011 designating a name of a component. The reference numeral 1012 designates an execution flag, with a value 1 being stored for those executing a process after exchange, and 0 being stored for those not executed. When a selection key 601 (FIG. 6A) is pressed, the execution flag 1012 is set, and when the process after the exchange finishes, it is cleared to zero. The reference numerals 1013, 1014, 1015 and 1016 store processes that should be executed after exchange in the order of execution.

For example, in FIG. 10B, the value 2 of the processing 1 of the intermediate transfer belt indicates that it corresponds to the processing ID 2 of FIG. 10A and it is counter clearance. The numbers in parentheses indicate priorities corresponding to the processing IDs shown in FIG. 10A (the description below is the same for the process 2 and the process 3 and so on).

Similarly, the value 5 of the process 2 of the intermediate transfer belt indicates that it corresponds to the processing ID 5 of FIG. 10A and that it is calibration <color shift correction>.

The value 3 of the process 3 of the intermediate transfer belt indicates that it corresponds to the processing ID 3 of FIG. 10A and that it is test printing.

Therefore, it indicates that processing after exchange of the intermediate transfer belt 30 is executed in the order of counter clearance, calibration <color shift correction>, and test printing.

Similarly, it indicates that processing after exchange of the photosensitive drum-Yellow 11*d* is executed in the order of counter clearance, calibration <gradation correction>, calibration <color shift correction>, and test printing.

It also indicates that processing after exchange of the developing unit-Yellow 14*d* is executed in the order of counter clearance, a toner density adjustment, and calibration <gradation correction>.

Next, processing of optimizing a procedure of determined processes for each component (execution order) will be described as the entire processing procedure.

Figure 2B:
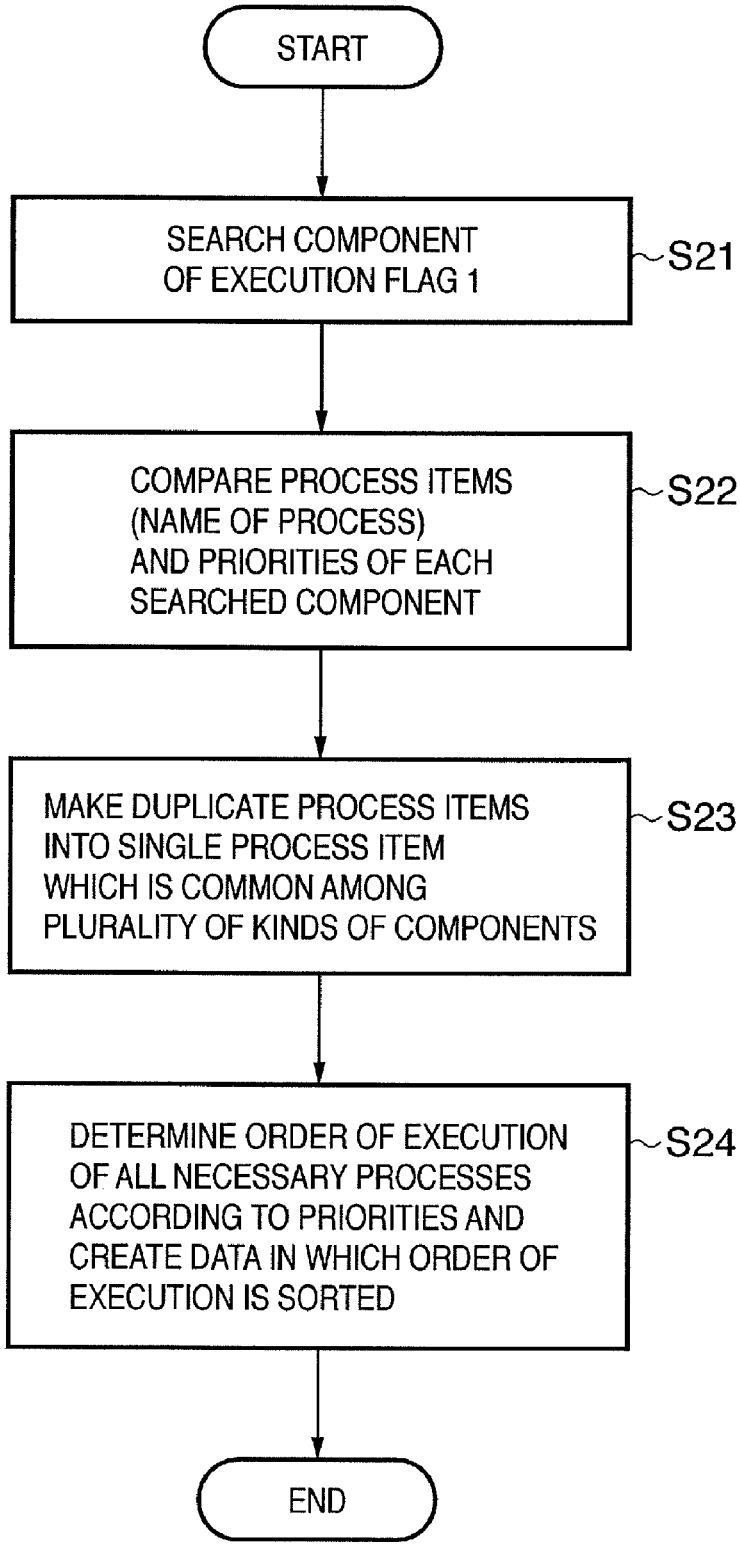
FIG. 2B is a flowchart for illustrating a processing procedure by its decision flow.

FIG. 2B is a flowchart for illustrating a flow of specific processes of determining an optimum processing procedure at the step S2. At the step S21, a component to which "1" is set in a column of an execution flag 1012 of FIG. 10B is searched. In such a case, the intermediate transfer belt 30, the photosensitive drum-Yellow 11*d* and the developing unit-Yellow 14*d* are to be optimized in the processing procedure.

Next, at the step S22, process items (name of process) and their priorities are compared for each component searched at the former step S21.

At the step S23, based on the result of comparison at the former step S22, duplicate process items are made into a single process item which is common among a plurality of kinds of components (make duplicate process items common).

Then at the step S24, the order of execution of all the processes needed for a plurality of kinds of components to be exchanged is determined according to the priorities and data in which the order of executing the processes is sorted (execution processing data) is created.

A decision unit (CPU 801) in the image forming apparatus according to the embodiment of the present invention can sort the execution order of process items needed for a plurality of kinds of components based on priority order information stored in the RAM 803 and the like, for example.

The decision unit (CPU 801) can make duplicate process items as a single process item common among a plurality of kinds of components by comparing the process items needed for a plurality of kinds of components based on information on the process items stored in the RAM 803 and the like.

The decision unit (CPU 801) can determine the execution order of a common single process item based on priority order information stored in the RAM 803 and the like.

If information on process items and priorities of the process items are changed, the decision unit (CPU 801) can determine the execution order of the process items needed for a plurality of kinds of components exchanged according to the change.

FIG. 10C is a diagram showing data (execution processing data) in which the execution order of processes is sorted according to the priorities generated at the step S24. The execution order of the processing is sorted for the entire components to be exchanged.

An example of specific processes from the former step S22 to S24 will be described with reference to FIG. 10B as below.

In the process 1 shown in FIG. 10B, counter clearance (processing ID 2) is a process duplicate among respective components (an intermediate transfer belt 30, a photosensitive drum-Yellow 11*d*, a developing unit-Yellow 14*d*) with priority order being 1 (S22 of FIG. 2B).

The counter clearance (processing ID 2) is set to the process 1 to be executed first as a common process as a whole (for once) (S23 of FIG. 2B) (S24 of FIG. 2B and FIG. 10C). A process for executing counter clearance for each component is a redundant process as mentioned in conventional arts, but a process to be redundantly executed twice are eliminated if a process is set for once as a common process among all as shown in FIG. 10C, and efficient processing is realized.

Next, process items for each component are compared for the process 2 shown in FIG. 10B (S22 of FIG. 2B). To the intermediate transfer belt 30, the calibration <color shift correction> (priority order is $4^{th}$) is set, and to the photosensitive drum-Yellow 11*d*, the calibration <gradation correction> (priority order is $3^{rd}$) is set. To the developing unit-Yellow 14*d*, the toner density adjustment (priority order is $2^{nd}$) is set.

If priorities are compared for the processes, it is arranged in the order of the toner density adjustment (priority order is $2^{nd}$), the calibration <gradation correction> (priority order is $3^{rd}$) and the calibration <color shift correction> (priority order is $4^{th}$) (S24 of FIG. 2B).

The test printing (priority order is $5^{th}$) is set to the intermediate transfer belt 30 for the process 3 of FIG. 10B, and the calibration <color shift correction> (priority order is $4^{th}$) is set for the photosensitive drum-Yellow 11*d*. The calibration <gradation correction> (priority order is $3^{rd}$) is set for the developing unit-Yellow 14*d*.

Here, in the process 3 of FIG. 10B, the calibration <color shift correction> (priority order is $4^{th}$) of the photosensitive drum-Yellow 11*d* is a process item duplicate with the intermediate transfer belt of the processing 2. In the process 3 of FIG. 10B, the calibration <gradation correction> (priority order is $3^{rd}$) of the developing unit-Yellow 14*d* is a process item duplicate with the processing of the photosensitive drum-Yellow 11*d* of the process 2 (S22 of FIG. 2B). The process items are sorted according to the priorities (S24 of FIG. 2B) with the duplicate process items as a single process item common among a plurality of kinds of components (S23 of FIG. 2B). In such a case, as shown in FIG. 10C, a toner density adjustment (ID1) of the priority order $2^{nd}$ is set for the process 2, and calibration <gradation correction> (ID4) of the priority order 3 is set for the process 3. Then, calibration <color shift correction> (ID5) of priority order $4^{th}$ is set to the process 4 (S24 of FIG. 2B).

A test printing (priority order is $5^{th}$) of the intermediate transfer belt in the process 3 of FIG. 10B becomes a process item duplicate with the processing of the photosensitive drum-Yellow 11*d* of the processing 4 (S22 of FIG. 2B). If the processing order is sorted according to priorities with the duplicate process items as a single process item common among a plurality of kinds of components (S23 of FIG. 2B), test printing (ID3) is set to the processing 5 of FIG. 10C (S24 of FIG. 2B).

With the abovementioned processes, an entire processing procedure can be determined (optimized) according to priorities with redundant processing as a single process item among a plurality of kinds of components for exchanging of components relating to the intermediate transfer belt, the drum-Yellow and the developing unit-Yellow.

It is a matter of course that the spirit of the present invention is not limited to the abovementioned kinds of components and can be applied to a kind of components which forms the image forming apparatus and can be exchanged.

Returning to the description to FIG. 2A, and the presence of a process to be executed will be determined at the step S3. If a process to be executed is not present as the entire processing procedure (S3-NO), it ends the processing. On the other hand, if a process to be executed is present (S3-YES), the processing proceeds to the step S4, where the process item is displayed and the processing proceeds to the processing step S5 which obtains determination of the execution of the displayed process item.

If the corresponding process is not executed at the step S5 (S5-NO), the processing returns to the step S3, where the presence of the processing to be executed next is determined. On the other hand, if the corresponding process is executed at the determination at the step S5 (S5-YES), the processing proceeds to the step S6, where the corresponding process is executed and the processing returns to the step S3 again, and determines the presence of the processing to be executed next.

In FIG. 10C, from the process 1 to the process 5 are determined (optimized) as the entire processing procedure, with each process being processed by processes from S3 to S6 in order.

(Display of a Process Item (S4 of FIG. 2*a*))

An example of displaying a process item at the step S4 will be described with reference from FIG. 11A to FIG. 11E. FIG. 11A to 11E are diagrams showing examples of displaying process items displayed on display unit (the touch panel portion 9001 of manipulation unit 900) as a sequential operation flow for the process needed.

(Display Example Relating to Counter Clearance (Process 1))

Figure 11A:
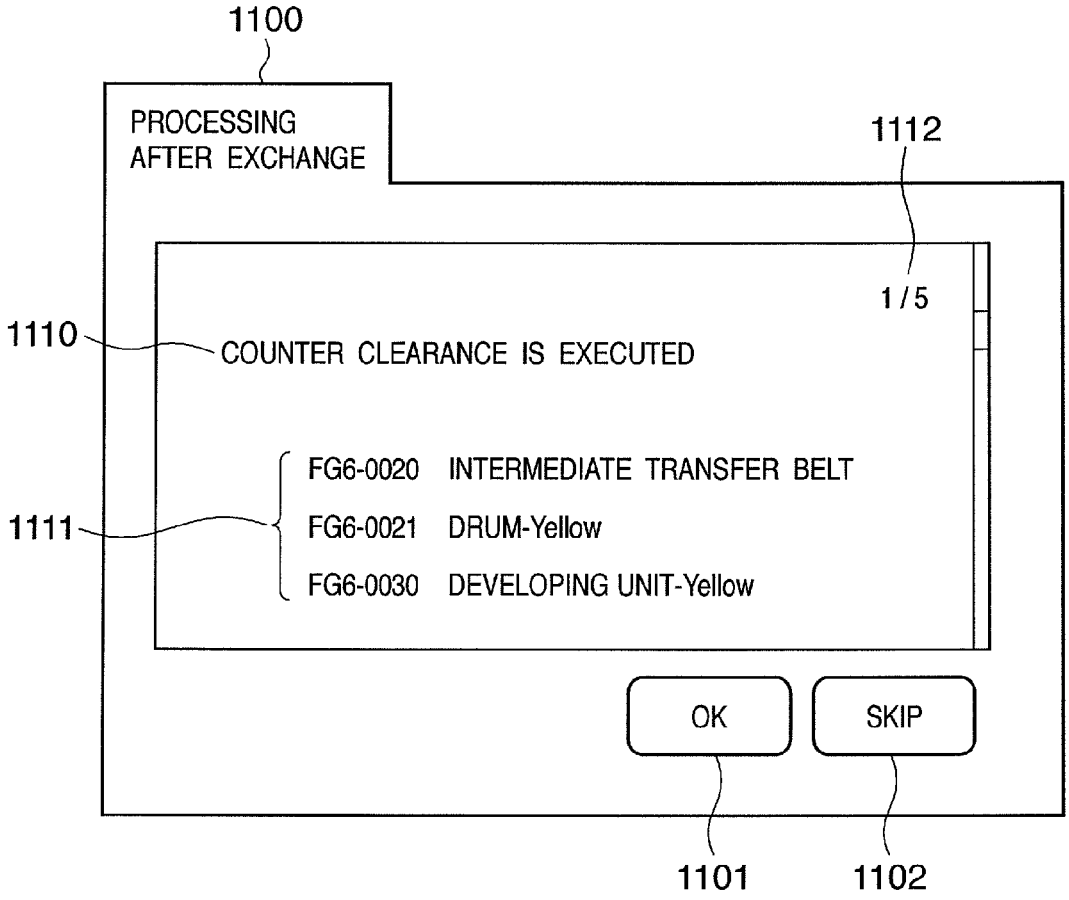
FIG. 11A is a diagram for exemplifying a process item relating to counter clearance in the image forming apparatus according to the embodiment of the present invention.

FIG. 11A is a diagram exemplifying a process item relating to counter clearance (process 1) in FIG. 10C. In the figure, the reference numeral 1110 designates a name of the process (in this case, counter clearance), and the reference numeral 1111 designates objective components (the intermediate transfer belt, the drum-Yellow, the developing unit-Yellow). And the reference numeral 1112 designates which number of process the displayed process item is in all the processes. In such a case, 1/5 indicates that it is the first in the processes 1 to 5.

The reference numeral 1101 is an OK key. When the worker presses the key, counters for objective components of the intermediate transfer belt, the drum-Yellow and the developing unit-Yellow are cleared under control of the CPU 801 and the processing is returned to the step S3 (S6 of FIG. 2A).

The reference numeral 1102 is a skip key. When the worker presses the key, the corresponding process is not executed and the display is switched to the display screen indicating the next process item. Switching of the display is executed under control of the CPU 801 which can function as a display control unit.

(Display Example of Toner Density Adjustment (Process 2))

At the step S3 to which the processing is returned, it is determined that the process 2 to be executed next is a toner density adjustment (ID1) from FIG. 10C, and the process item corresponding to the toner density adjustment is displayed at the step S4 and the processing proceeds to the step S5.

Figure 11B:
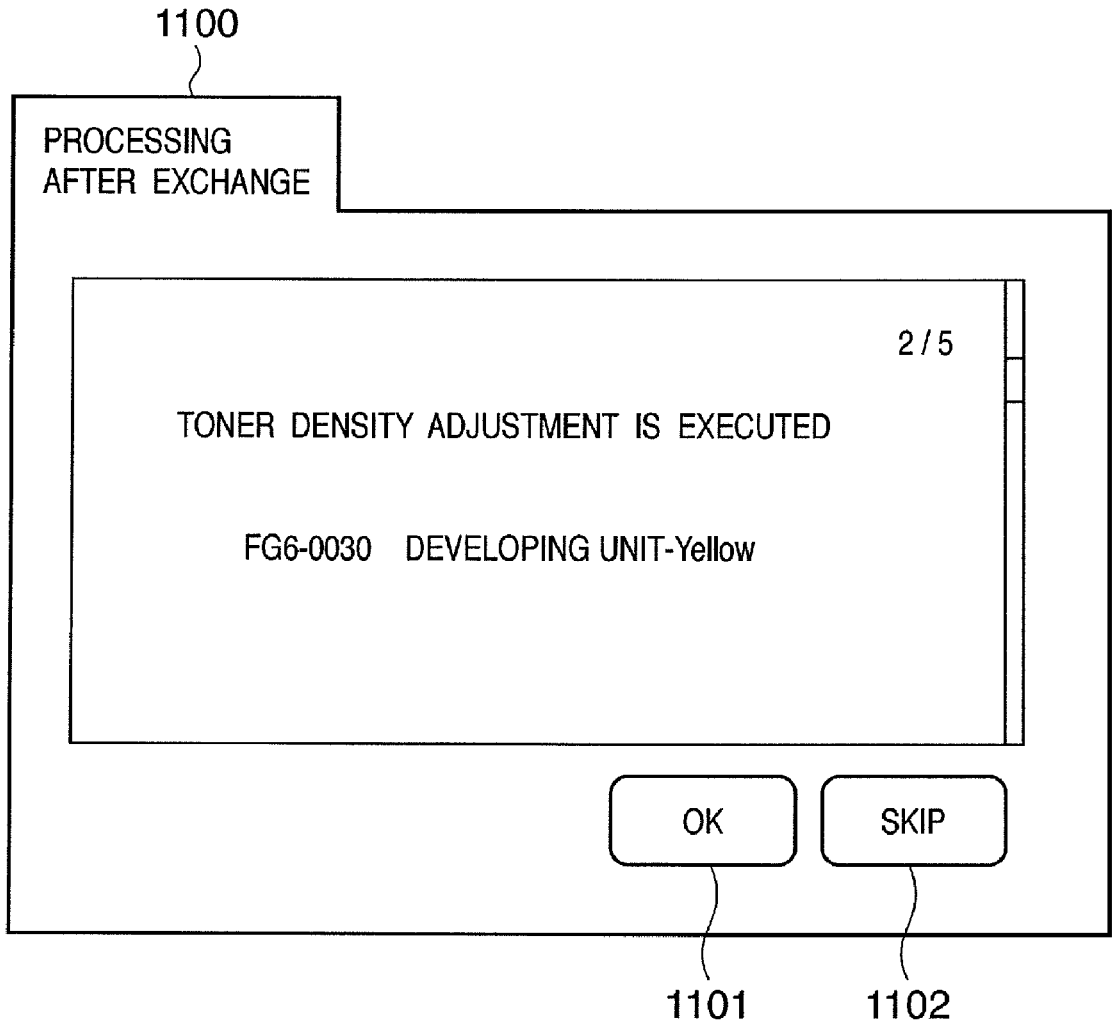
FIG. 11B is a diagram for exemplifying a process item relating to toner density adjustment in the image forming apparatus according to the embodiment of the present invention.

FIG. 11B is a diagram for exemplifying process items for toner density adjustment (process 2) in FIG. 10C. The objective component is the developing unit-Yellow 14*d*. When the worker presses the OK button 1101, toner density adjustment is executed under the control of the CPU 801. The toner density adjustment of the developing unit is to stir toner in the developing unit for a predetermined time, take a toner density signal in at exchange as a reference signal, and store it in a predetermined region on the RAM 803. After the process ends, the processing is returned from the step S6 to the step S3 again.

On the other hand, if the worker selects a skip key 1102, the toner density adjustment is not executed and the processing is returned to the step S3.

(Display Example Relating to Gradation Correction of Calibration (Process 3))

At the step S3 to which the processing is returned, the process 3 to be executed next is determined as the gradation correction of calibration from FIG. 10C, and at the step S4, the process item corresponding to the gradation correction of the calibration is displayed and the processing proceeds to the step S5.

Figure 11C:
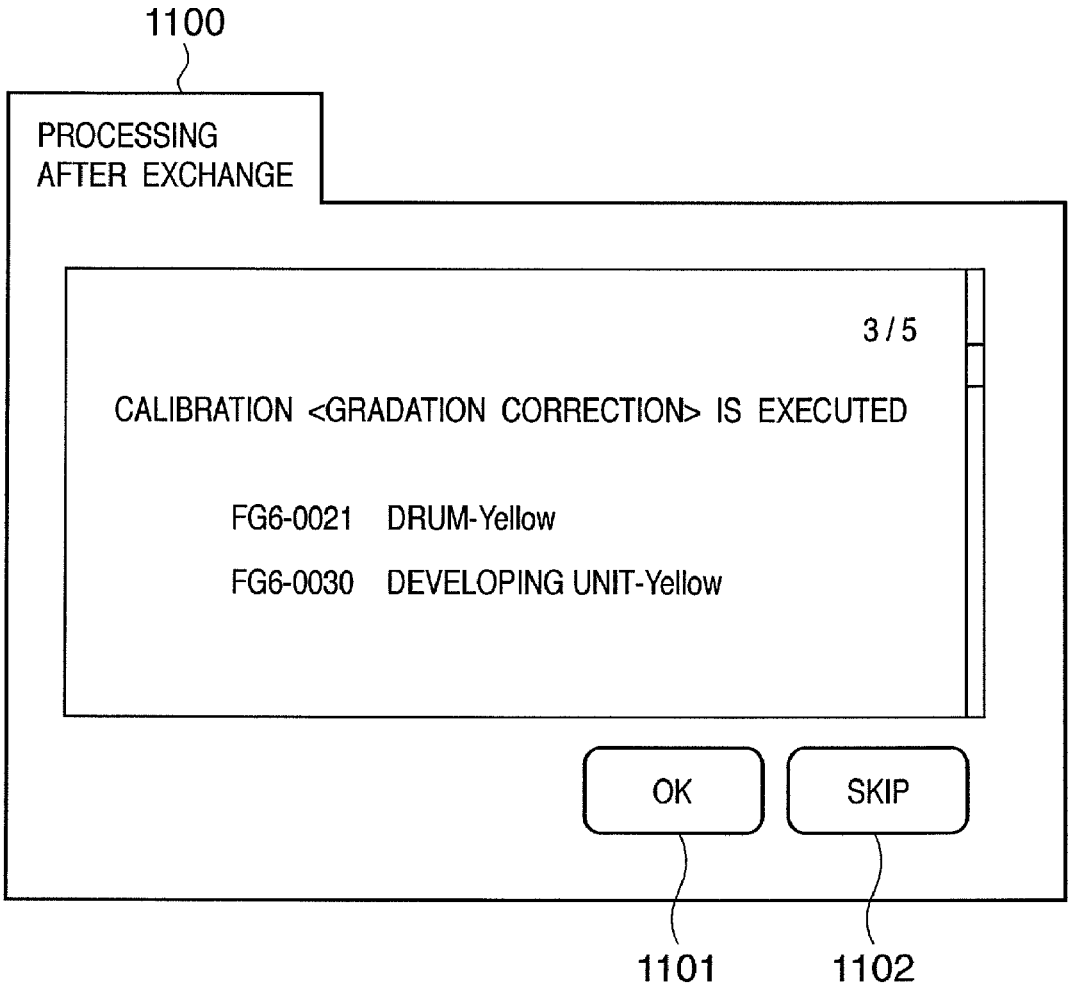
FIG. 11C is a diagram for exemplifying a process item relating to gradation correction of calibration in the image forming apparatus according to the embodiment of the present invention.

FIG. 11C is a diagram for exemplifying a process item relating to gradation correction (process 3) of calibration in FIG. 10C. Here, an objective component is the photosensitive drum-Yellow 11*d* and the developing unit-Yellow 14*d*.

When the worker presses the OK button 1101, gradation correction of calibration is executed under the control of the CPU 801. In the gradation correction, 16 gradations of patches are created on the photosensitive drum-Yellow 11*d*, and density of each patch is read by a patch detection sensor (not shown) provided by a photosensitive drum and a laser power and an LUT are corrected so that a desired gradation is obtained. After the processes end, the processing is returned from the step S6 to the step 3 again.

On the other hand, if the worker selects the skip key 1102, gradation correction of calibration is not executed and the processing is returned to the step S3.

(Display Example Relating to Color Shift Correction of Calibration (Process 4))

At the step S3 to which the processing is returned, the process 4 to be executed next is determined as the color shift correction of calibration from FIG. 10C, and at the step S4, the process items corresponding to the color correction of calibration is displayed, and the processing proceeds to the step S5.

Figure 11D:
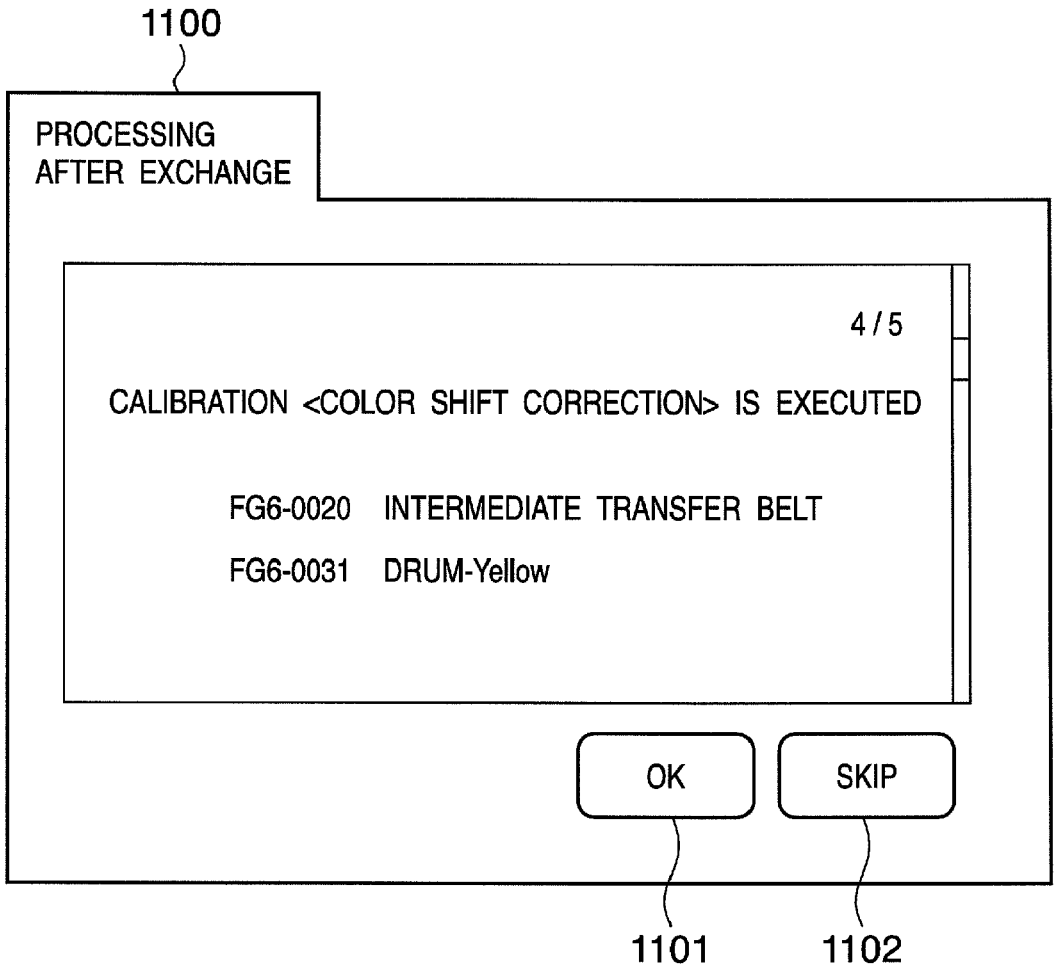
FIG. 11D is a diagram for exemplifying a process item relating to color shift correction of calibration in the image forming apparatus according to the embodiment of the present invention.

FIG. 11D is a diagram for exemplifying process items relating to color shift correction of calibration (process 4) in FIG. 10C. Here, an objective component is the intermediate transfer belt 30 and the photosensitive drum-yellow 11*d*.

When the worker presses the OK button 1101, the color shift correction of calibration is executed under the control of the CPU 801. In the color shift correction, first, a color shift detecting patch for each color of Y, M, C, and K is formed on the intermediate transfer belt 30. The amounts of shift of patches of Y, C, and K are detected against the patch of M by a resist-detect sensor (not shown) provided on the intermediate transfer belt, and a laser writing positions in a primary scanning direction and a secondary scanning direction are corrected so that the amounts of shift is minimum. After the processes end, the processing is returned from the step S6 to the step S3 again.

On the other hand, if the worker selects the skip key 1102, the gradation correction of calibration is not executed and the processing is returned to the step S3.

(Display Example Relating to Test Printing (Process 5))

At the step S3 to which the processing is returned, the process 5 to be executed next is determined as test printing from FIG. 10C, and at the step S4, a process item corresponding to the test printing is displayed at the step S4 and the processing proceeds to the step S5.

Figure 11E:
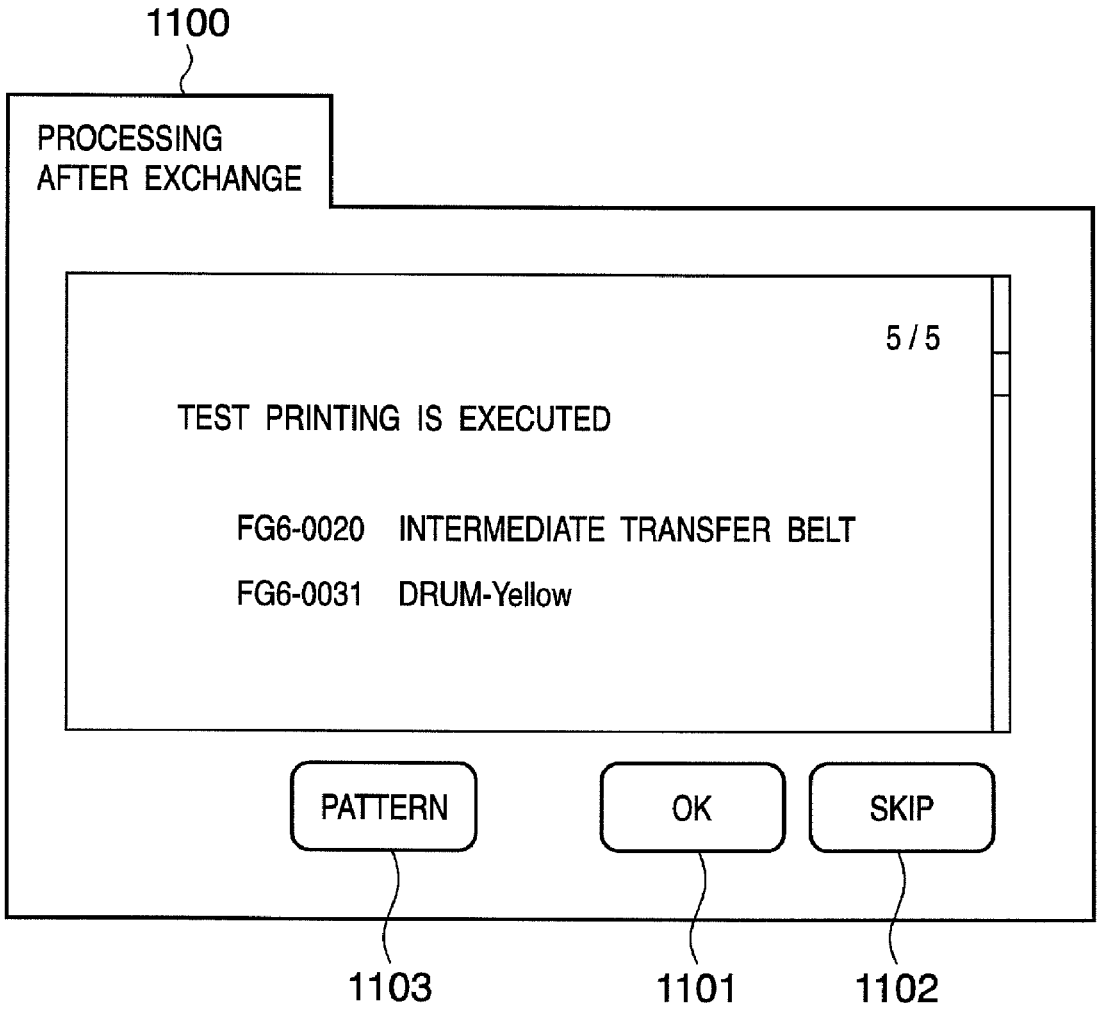
FIG. 11E is a diagram for exemplifying a process item relating to test printing in the image forming apparatus according to the embodiment of the present invention.

FIG. 11E is a diagram for exemplifying a process item relating to test printing (process 5) in FIG. 10C. Objective components are the intermediate transfer belt 30 and the photosensitive drum-Yellow 11*d*.

When the worker presses the OK button 1101, the test printing is executed under the control of the CPU 801. In the test printing, an image specified by a pattern key 1103 is printed on a recording material and discharged from the image forming apparatus. After the processes end, the processing is returned from the step S6 to the step S3 again. If a plurality of patterns are specified, the processing is returned to the step S3 after all the patterns are printed.

On the other hand, if the worker selects the skip key 1102, the gradation correction of calibration is not executed and the processing is returned to the step S3.

At the step S3 to which the processing is returned, the process 6 to be executed next is determined as not present from FIG. 10C, the processing after exchanging the component ends.

In the embodiment, a procedure of executing the processes as a worker checks each process as shown in FIGS. 11A to 11E after the execution key 603 of the components to be exchanged specifying screen 600 of FIG. 6A is selected has been described. The spirit of the present invention, however, is not limited to that and the processes can be set to be executed collectively without requiring a worker to check after the execution key 603 of the components to be exchanged specifying screen 600 is selected.

As mentioned above, according to the embodiment, if a plurality of kinds of components are exchanged, processes needed and the order of the processes are determined and they can be displayed on display unit as a sequential operation flow.

Accordingly, an operator or the like can lower downtime of an apparatus by streamlining of operations and prevent occurrence of operation errors by an operator or the like by selecting and executing a provided sequential operation flow.

Other Embodiments

It is a matter of course that the object of the present invention can be achieved by providing a storing medium that records program codes of a software program for realizing the abovementioned functions of the embodiment for a system or an apparatus. It is also a matter of course that it can be achieved by a computer (or a CPU or an MPU) of the system or the apparatus to read and execute the program codes stored in the storing medium.

In such a case, program codes themselves read from the storing medium realize the abovementioned functions of the embodiment and the storing medium that stores the program codes comprises the present invention.

As a storing medium for providing program codes, a flexible disk, a hard disk, an optical disk, a magneto-optical disk, a CD-ROM, a CD-R, a non-volatile memory card, ROM or the like, for example can be used.

The abovementioned functions of the embodiment are realized as program codes read by a computer are executed. It is a matter of course that a case where an OS (operating system) or the like running on a computer performs a component or all of the actual processes, based on instructions of the program codes and the abovementioned embodiment is realized by the processes can be included.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-258307, filed on Sep. 6, 2005, which is hereby incorporated by reference herein in its entirety.

What is claimed is:

1. An image forming apparatus, which can display processes relating to exchanged components on a display unit according to a determined order of execution comprising:

a searching unit for searching a plurality of kinds of exchanged components;

a determination unit adapted to determine process items needed to be executed based on instruction by the operator as components are exchanged and an order of executing the process items needed for the plurality of kinds of exchanged components searched by the searching unit based on priority order information of the process items;

a display control unit adapted to cause said display unit to control a display for ordering to execute process items needed for the components according to the order of execution determined by said determination unit; and a storing unit adapted to store process items needed for each component and information relating to priority order for each of the process items;

wherein said determination unit compares process items needed for the plurality of kinds of components based on information on process items stored in said storing unit and makes duplicate process items a single process item which is common among the plurality of kinds of exchanged components.

2. The image forming apparatus according to claim 1, wherein said determination unit sorts the order of execution of process items needed for the plurality of kinds of components based on priority order information stored in said storing unit.

3. The image forming apparatus according to claim 1, wherein said determination unit determines an order of execution of the common single process item based on priority order information stored in said storing unit.

4. The image forming apparatus according to claim 1, wherein, if the process items and information on priority order for each of the process items are changed, said determination unit determines an order of executing process items needed for the plurality of kinds of exchanged components according to the change.

5. An image forming apparatus, which can display processes relating to exchanged components on a display unit according to a determined order of execution comprising:

a searching unit for searching a plurality of kinds of exchanged components;

a determination unit adapted to determine process items needed to be executed based on instruction by the operator as components are exchanged and an order of executing the process items needed for the plurality of kinds of exchanged components searched by the searching unit based on priority order information of the process items; and a display control unit adapted to cause said display unit to control a display for ordering to execute process items needed for the components according to the order of execution determined by said determination unit;

wherein the plurality of kinds of exchanged components include at least a photosensitive drum and a developing unit.

6. The image forming apparatus according to claim 5, further comprising a storing unit adapted to store process items needed for each component and information relating to priority order for each of the process items.

7. The image forming apparatus according to claim 6, wherein said determination unit sorts the order of execution of process items needed for the plurality of kinds of components based on priority order information stored in said storing unit.

8. The image forming apparatus according to claim 5, wherein, if the process items and information on priority order for each of the process items are changed, said determination unit determines an order of executing process items needed for the plurality of kinds of exchanged components according to the change.

9. A controlling method of an image forming apparatus which can display processes relating to exchanged components on a display unit according to a determined order of execution, comprising:

a searching step of searching a plurality of kinds of exchanged components;

a determination step of determining process items needed to be executed based on instruction by the operator as the exchanged components and an order of executing the process items needed for the plurality of kinds of components searched in said searching step based on priority order information of the process items; and a display control step of causing said display unit to control a display for ordering to execute process items needed for the components according to the order of execution determined in said determination step, wherein the plurality of kinds of exchanged components include at least a photosensitive drum and a developing unit.

* * * * *